US008303442B2

(12) United States Patent
Smith et al.

(10) Patent No.: US 8,303,442 B2
(45) Date of Patent: Nov. 6, 2012

(54) SPORTING BALL WITH ENHANCED VISUAL ACUITY

(75) Inventors: Todd Smith, West Linn, OR (US); Alan W. Reichow, Beaverton, OR (US); Karl Citek, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/315,593

(22) Filed: Dec. 9, 2011

(65) Prior Publication Data

US 2012/0142462 A1 Jun. 7, 2012

Related U.S. Application Data

(62) Division of application No. 11/942,520, filed on Nov. 19, 2007, now Pat. No. 8,075,431.

(60) Provisional application No. 60/917,532, filed on May 11, 2007.

(51) Int. Cl.
*A63B 41/00* (2006.01)

(52) U.S. Cl. ..... 473/604; 473/598; 473/599; 473/600; 473/603; 473/607; D21/707; D21/713; 40/327

(58) Field of Classification Search ..... 473/598, 473/599, 600, 603, 604, 607; D21/707, 713; 40/327

See application file for complete search history.

(56) References Cited

U.S. PATENT DOCUMENTS

| | | | |
|---|---|---|---|
| 676,506 | A | 6/1901 | Knight |
| D45,734 | S | 5/1914 | Worthington |
| 1,187,029 | A | 6/1916 | Beebout |
| D194,688 | S | 2/1963 | Santora |
| 3,425,693 | A | 2/1969 | Murry |
| 3,861,790 | A | 1/1975 | Tamura |
| 4,170,352 | A | 10/1979 | Vcala |
| 4,345,759 | A | 8/1982 | Nims |
| 4,596,389 | A | 6/1986 | Frankowski |

(Continued)

FOREIGN PATENT DOCUMENTS

FR 2358904 2/1978

(Continued)

OTHER PUBLICATIONS

Reichow, et al., "Introduction to Behavioral Optometry", Sports Vision, 1993, 75 pages, Optometric Extension Program Foundation, United States.

(Continued)

*Primary Examiner* — Kurt Fernstrom
*Assistant Examiner* — Joseph B Baldori
(74) *Attorney, Agent, or Firm* — Shook, Hardy & Bacon L.L.P.

(57) ABSTRACT

Sporting balls with enhanced visual acuity, casings for sporting balls with enhanced visual acuity, and methods for enhancing visual acuity of a soccer ball are described. In embodiments, the sporting ball has an exterior with a substantially spherical surface including a first pole opposing a second pole and an equator circumferentially intermediate the first pole and the second pole. Additionally, in embodiments a first exterior region of a first color may include a first hub section oriented at the first pole generally opposite a second hub section oriented at the second pole on the substantially spherical surface. The first hub section may have one or more first hub spokes extending spherically outwardly therefrom toward the equator, and the second hub section may have one or more second hub spokes extending spherically outwardly therefrom toward the equator. Further, in embodiments, the sporting ball may have a second exterior region of a second color.

8 Claims, 14 Drawing Sheets

U.S. PATENT DOCUMENTS

| | | | |
|---|---|---|---|
| 4,660,834 | A | 4/1987 | Carrigan |
| 4,796,888 | A | 1/1989 | Louez |
| 4,991,838 | A | 2/1991 | Groves |
| 5,050,982 | A | 9/1991 | Meissner |
| 5,067,719 | A | 11/1991 | Mook |
| 5,230,512 | A | 7/1993 | Tattershall |
| 5,419,552 | A | 5/1995 | Meyer |
| 5,427,372 | A | 6/1995 | Ratner |
| 5,470,058 | A | 11/1995 | Sullivan |
| 5,478,239 | A | 12/1995 | Fuerst |
| 5,503,699 | A | 4/1996 | Ratner |
| 5,564,707 | A | 10/1996 | Dinh |
| 5,711,725 | A | 1/1998 | Bengtson |
| D393,020 | S | 3/1998 | Arcos |
| 5,741,195 | A | 4/1998 | Sullivan |
| 5,778,793 | A | 7/1998 | Mello |
| 5,842,866 | A | 12/1998 | Chow |
| D414,229 | S | 9/1999 | Sohn |
| 6,331,151 | B2 | 12/2001 | Calandro |
| D453,037 | S | 1/2002 | Frisina |
| 6,375,783 | B1 | 4/2002 | Davis |
| 6,422,949 | B1 | 7/2002 | Byrne |
| 6,752,732 | B2 | 6/2004 | Morrison |
| 6,755,525 | B2 | 6/2004 | Reichow |
| 6,811,258 | B1 | 11/2004 | Grant |
| D501,900 | S | 2/2005 | Gammon |
| 6,893,127 | B2 | 5/2005 | Reichow |
| D512,472 | S | 12/2005 | Nishihara |
| 7,073,208 | B2 | 7/2006 | Penque |
| D529,107 | S | 9/2006 | Just |
| 7,167,246 | B1 | 1/2007 | Skierski |
| 7,241,234 | B2 | 7/2007 | Eite |
| D548,292 | S | 8/2007 | Smith |
| D548,806 | S | 8/2007 | Smith |
| D575,364 | S | 8/2008 | Smith |
| 7,568,986 | B2 | 8/2009 | Watanabe et al. |
| 2002/0032076 | A1 | 3/2002 | Isogawa |
| 2003/0198924 | A1 | 10/2003 | Eite |
| 2005/0170920 | A1 | 8/2005 | Boyer |
| 2005/0221919 | A1 | 10/2005 | Eite |
| 2006/0035723 | A1 | 2/2006 | Chapman |
| 2007/0049433 | A1 | 3/2007 | Laliberty |
| 2007/0084095 | A1 | 4/2007 | Wellington, Jr. |
| 2008/0076610 | A1 | 3/2008 | Torres |

FOREIGN PATENT DOCUMENTS

| | | |
|---|---|---|
| WO | 9826326 | 6/1998 |

OTHER PUBLICATIONS

Ferreira, "An Overview of Research in Sports Vision: its History and an Optometric Perspective", The South African Optometrist, Dec. 2003, pp. 142-149, vol. 62, No. 4, Auckland Park, South Africa.

Coffey, et al., "Visual Performance Enhancement in Sports Optometry", Sports Vision 1995, pp. 158-177, Butterworth-Heinermann, United States.

Cardall, "Contact Lenses in Sport: a General Overview", Optician, Jan. 13, 2006, pp. 22-25, vol. 231, No. 6034, United States.

Rouse, et al., "A Comparison Study of Dynamic Visual Acuity Between Athletes and Nonathletes", Journal of the American Optometric Association, Dec. 1988, pp. 946-950, vol. 59, No. 12, United States.

Koenig, "Practicing Perception: Eyes Can Be Trained to be More Effective", USA Today Baseball Weekly, 1996, 3 pages, United States.

Coffey, et al., "Optometric Evaluation of the Elite Athlete," Problems in Optometry, Mar. 1990, pp. 32-59, vol. 2, No. 1, United States.

Reichow, et al., "A Comparison of Contrast Sensitivity in Elite Athletes Versus a Normal Population", American Journal of Optometry and Physiological Optics, Dec. 15, 1986, vol. 63, No. 82, United States.

Farrow, et al., "An Investigation of the Effectiveness of Bolle's Competivision Sport-Glasses on Tennis Performance", Clinical and Experimental Optometry, Jul.-Aug. 2000, pp. 226-231, vol. 83, No. 4.

Herdman, et al., "Computerized Dynamic Visual Acuity Test in the Assessment of Vestibular Deficits", The American Journal of Otology, 1998, pp. 790-796, vol. 19, No. 6, United States.

Tian, et al., "Dynamic Visual Acuity During Transient and Sinusoidal Yaw Rotation in Normal Ulilaterally Vestibulopathic Humans", Experimental Brain Research, Feb. 8, 2001, pp. 12-25, vol. 137, Springer-Verlag, United States.

Reichow, et al., "Ultraviolet and Short Wavelength Visible Light Exposure: Why Ultraviolet Protection Alone is Not Adequate", Journal of Long-Term Effects of Medical Implants, 2006, pp. 315-325, vol. 16, No. 4, Begell House, Inc., United States.

Advisory Action mailed Aug. 25, 2006 for U.S. Appl. No. 10/770,862, filed Feb. 2, 2004.

Advisory Action mailed Mar. 27, 2008 for U.S. Appl. No. 10/770,862, filed Feb. 2, 2004.

Final Office Action mailed May 10, 2006 for U.S. Appl. No. 10/770,862, filed Feb. 2, 2004.

Final Office Actiion mailed Jan. 7, 2008 for U.S. Appl. No. 10/770,862, filed Feb. 2, 2004.

Final Office Action mailed Apr. 3, 2009 for U.S. Appl. No. 10/770,862, filed Feb. 2, 2004.

International Search Report mailed Sep. 7, 2006 for Appl. No. PCT/U05/04526, filed Feb. 9, 2005.

International Search Report mailed Apr. 14, 2008 for PCT/US05/002904, filed Jan. 31, 2005.

International Search Report mailed Aug. 29, 2008 for Appl. No. PCT/US08/63416, filed May 12, 2008.

International Search Report mailed Sep. 5, 2008 for Appl. No. PCT/US08/63425, filed May 12, 2008.

International Search Report mailed Nov. 26, 2009 for Appl. No. PCT/US08/63416, filed May 12, 2008.

Non-Final Office Action mailed Jun. 8, 2005 for U.S. Appl. No. 10/770,862, filed Feb. 2, 2004.

Non-Final Office Action mailed Oct. 19, 2005 for U.S. Appl. No. 10/770,862, filed Feb. 2, 2004.

Non-Final Office Action mailed Jul. 24, 2007 for U.S. Appl. No. 10/770,862, filed Feb. 2, 2004.

Non-Final Office Action mailed Jul. 1, 2008 for U.S. Appl. No. 10/770,862, filed Feb. 2, 2004.

Non-Final Office Action mailed Jun. 4, 2009 for U.S. Appl. No. 11/801,931, filed May 11, 2007.

Non-Final Office Action mailed Oct. 8, 2009 for U.S. Appl. No. 11/801,931, filed May 11, 2007.

Non-Final Office Action mailed Dec. 15, 2009 for U.S. Appl. No. 10/770,862, filed Feb. 2, 2004.

Non-Final Office Action mailed Dec. 15, 2009 for U.S. Appl. No. 11/717,894, filed Mar. 13, 2007.

Notice of Allowance mailed Feb. 2, 2007 for U.S. Appl. No. 10/770,862, filed Feb. 2, 2004.

Final Office Action mailed Jun. 30, 2010 for U.S. Appl. No. 10/770,862, filed Feb. 2, 2004.

Final Office Action mailed Sep. 2, 2010 for U.S. Appl. No. 11/717,894, filed Mar. 13, 2007.

Non Final Office Action mailed Mar. 25, 2010 for U.S. Appl. No. 11/717,894, filed Mar. 13, 2007.

Non Final Office Action mailed Apr. 6, 2011 for U.S. Appl. No. 11/801,931, filed May 11, 2007.

Non Final Office Action mailed Nov. 22, 2010 for U.S. Appl. No. 10/770,862, filed Feb. 2, 2004.

Final Office Action mailed Apr. 28, 2011 for U.S. Appl. No. 10/770,862, filed Feb. 2, 2004.

Advisory Action mailed Feb. 19, 2010 for U.S. Appl. No. 11/942,520, filed Nov. 19, 2007.

Non-Final Office Action mailed Jul. 28, 2009 for U.S. Appl. No. 11/942,520, filed Nov. 19, 2007.

Final Office Action mailed Apr. 22, 2010 for U.S. Appl. No. 11/801,931, filed May 11, 2007.

Final Office Action mailed Mar. 11, 2011 for U.S. Appl. No. 11/942,520, filed Nov. 19, 2007.

Notice of Allowance mailed Feb. 16, 2011 for U.S. Appl. No. 11/717,894, filed Mar. 13, 2007.

Final Office Action of Sep. 22, 2011 for U.S. Appl. No. 11/801,931, filed May 11, 2007.

SPORTING BALL WITH ENHANCED VISUAL ACUITY

CROSS-REFERENCE TO RELATED APPLICATIONS

This application is a divisional application of U.S. application Ser. No. 11/942,520, entitled "Sporting Ball With Enhanced Visual Acuity", filed Nov. 19, 2007 which claims priority to provisional Application No. 60/917,532, entitled "SPORTING BALL WITH ENHANCED VISUAL ACUITY," filed on May 11, 2007, the entirety of the aforementioned applications are incorporated by reference herein in their entireties.

BACKGROUND

In many sport activities, vision plays a fundamental role. Those players that excel in many activities must coordinate physical prowess with visual awareness to reach their full potential. Not only is sharp vision important in team sports, such as baseball, basketball, hockey, soccer, football, etc., where players pass a ball or puck between one another. Visual acuity is also important in myriad individual sporting activities such as running, biking, mountain climbing, tennis, golf, and skiing. A variety of advances have improved the visual environment in many sports, allowing players to have greater awareness and giving players the capabilities to improve their abilities. For instance, in skiing, specific skiing goggles exist, allowing skiers to better observe contours of the snow on a run. In tennis, the tennis ball is a bright yellow color, attracting players' attention and allowing the players to follow the ball's motion. In golf, advances have improved the brightness of golf balls, so that players can more easily locate their shots and avoid costly penalty strokes.

Despite the advancements to date, in many sporting activities there is significant room for improving visual acuity. For example, in various sports a ball moves with high velocity between players, quickly accelerating and decelerating as players interact with the ball. In such sports balls often also spin, which can greatly alter how a player interacts with the ball. Although graphics may exist on the ball, the graphics are typically structural markings such as stitching, or marketing graphics, such as the name of a manufacturer or a league name. In these instances, the graphics are neither designed nor intended to improve visual acuity. Yet it would be highly advantageous for a player to have the ability to notice the ball (e.g., by recognizing the ball in a player's peripheral vision) and track the movement of the ball more easily. For example, if a player could more easily locate a ball because when the ball spins it creates a "flicker" (spinning from a light portion to a dark portion and back), and more easily track the ball because of specially-designed graphics enhancing visual acuity, the player's performance would be benefited.

SUMMARY

Embodiments of the present invention provide sporting balls with enhanced visual acuity, casings for sporting balls with enhanced visual acuity, and methods for increasing visual acuity of balls. In various embodiments, the sporting ball may have an exterior having a substantially spherical surface including a first pole opposing a second pole and an equator intermediate the first pole and the second pole. In these embodiments, a first exterior region of a first color may include a first hub section oriented at the first pole generally opposite a second hub section oriented at the second pole on the substantially spherical surface. Additionally, the first hub section may have one or more first hub spokes extending spherically outwardly toward the equator, and the second hub section may have one or more second hub spokes extending spherically outwardly toward the equator. Further, in these embodiments a second exterior region may have a second color. A sporting ball in accordance with the present invention may, for example, be an American soccer ball.

Superior Visibility for balls in accordance with the present invention can be provided by appropriate selection of object colors and color patterns. For example, objects for use in sports, such as soccer balls or other balls, can comprise an exterior having a first exterior region with a spectral reflectance associated with a first color of a pair of enhanced-visibility colors (EVCs) and a second exterior region associated with a second color of the pair. The first color and the second color may be substantially complementary and may be associated with a luminance contrast of greater than about 50%. For example, the first color may be substantially yellow and the second color may be substantially blue or purple. By way of further example, the first exterior region and the second exterior region may be substantially non-reflective in a spectral window associated with a background such as grass or blue sky. As a further example, the first region and the second region may be substantially diffusely reflective.

Balls for team or individual sports may comprise a cover having a first color region and a second color region configured to be viewable while the ball is in play. Such regions may be configured to, for example, aid in ball location or estimation of ball rotation and/or speed. The first color region and the second color region may have spectral reflectances associated with substantially complementary colors. Color space locations of the substantially complementary colors may be separated by at least 50% of a chromatic blend limit. In additional examples, a chromatic blend line associated with the complementary colors may be separated from a central white color space location by less than 25% of the chromatic blend limit. In further examples, color space locations of the substantially complementary colors may be separated by at least 75% of a chromatic blend limit. In other examples, a chromatic blend line associated with the complementary colors may be separated from a central white color space location by less than 10% of the chromatic blend limit. In further examples, substantially complementary colors C1 and C2 may be associated with respective CIE L-a-b coordinates ($C1_L$, $C1_a$, $C1_b$) and ($C2_L$, $C2_a$, $C2_b$), wherein a color difference $CD=\sqrt{(C1_a-C2_a)^2+(C1_b-C2_b)^2}$ is greater than about 50. In further examples, the color difference CD is greater than about 100. In other examples, a total color difference TCD between the first region and the second region is at least about 50 or at least about 100, wherein $TCD=\sqrt{(C1_a-C2_a)^2+(C1_b-C2_b)^2+(C1_L-C2_L)^2}$. In additional examples, the substantially complementary colors have a luminance contrast between the first region and the second region of at least 50%.

Methods of selecting colors for a sports item may comprise defining a chromatic blend line and selecting a first color location and a second color location on the chromatic blend line, wherein the first color location and the second color location are separated by at least 50% of a chromatic blend limit (CBL). A first color and a second color may be selected based on the first color location and the second color location. In a representative example, the chromatic blend line may be separated from a central white color space location by less than about 20% of the chromatic blend limit. In additional examples, a color vision deficiency to be accommodated may be selected, and the chromatic blend line may be selected to be substantially perpendicular to an associated color vision deficiency line of confusion. In further examples, a background spectral window may be selected based on an anticipated background for viewing the sports item. A reflectance of at least one of the first color and/or the second color may be reduced in at least a portion of the background spectral window. In other examples, the first color and the second color are selected to provide a predetermined luminance contrast.

It should be noted that this Summary is provided to generally introduce the reader to one or more select concepts described below in the Detailed Description in a simplified form. This Summary is not intended to identify key and/or required features of the claimed subject matter, nor is it intended to be used as an aid in determining the scope of the claimed subject matter.

BRIEF DESCRIPTION OF THE DRAWINGS

These and other objectives and advantages of the present invention will be more readily apparent from the following detailed description of the drawings of the preferred embodiment of the invention that are herein incorporated by reference and in which.

DETAILED DESCRIPTION

Figure 1:
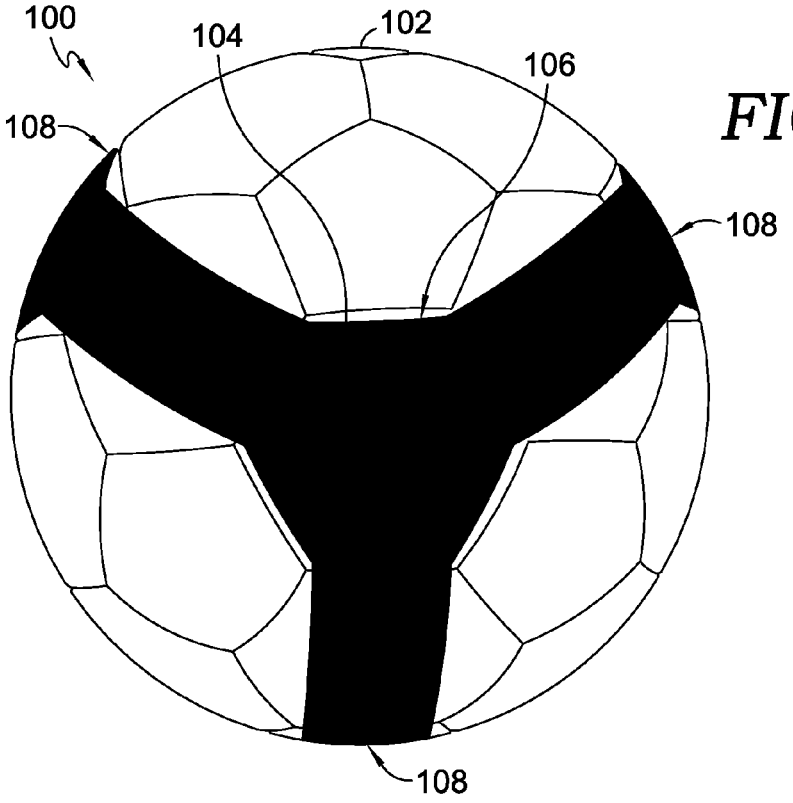
FIG. 1 is a profile view of a sporting ball with enhanced visual acuity, including one hemisphere, in accordance with an embodiment of the present invention.

The subject matter of the present invention is described with specificity herein to meet statutory requirements. The description itself, however, is not intended to limit the scope of this patent. Rather, the inventors have contemplated that the claimed subject matter might also be embodied in other ways, to include different aspects as well as other steps or combinations of steps similar to the one described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described Embodiments of the present invention provide sporting balls, casings for sporting balls, and methods for increasing visual acuity of sporting balls. Sporting balls in accordance with the present invention may comprise American soccer balls. In various embodiments, the sporting ball may have an exterior having a substantially spherical surface including a first pole opposing a second pole and an equator intermediate the first pole and the second pole. In these embodiments, a first exterior region of a first color may include a first hub section oriented at the first pole generally opposite a second hub section oriented at the second pole on the substantially spherical surface. Additionally, the first hub section may have one or more first hub spokes extending spherically outwardly toward the equator, and the second hub section may have one or more second hub spokes extending spherically outwardly toward the equator. Further, in these embodiments a second exterior region may have a second color. While embodiments discussed herein refer to soccer balls, it will be understood and appreciated by one of ordinary skill in the art that embodiments are not limited to any particular style or type of sporting ball. For example, other embodiments may include baseballs, tennis balls, racquetballs, basketballs, volleyballs, rugby balls, and the like with enhanced visual acuity.

Accordingly, in one aspect, the present invention is directed to a sporting ball with enhanced visual acuity. The sporting ball includes an exterior having a substantially spherical surface including a first pole opposing a second pole and an equator intermediate the first pole and the second pole. In this aspect, the sporting ball further includes a first exterior region of a first color including a first hub section oriented at the first pole. The first hub section is generally opposite a second hub section oriented at the second pole on the substantially spherical surface. The first hub section has one or more first hub spokes extending spherically outwardly toward the equator. Similarly, the second hub section has one or more second hub spokes extending spherically outwardly toward the equator. Further, in this aspect, the sporting ball includes a second exterior region of a second color.

In another aspect, the present invention is directed to a casing in a sporting ball with enhanced visual acuity. The casing includes an exterior capable of being configured into a substantially spherical surface. The exterior includes a first hemisphere, a second hemisphere, and an equator oriented between the first hemisphere and the second hemisphere. In this aspect, the first hemisphere has three spherical substantially triangular first flicker regions of a first color with a first non-flicker region of a second color oriented between the first flicker regions. Each first flicker region has two congruent sides and a base, and the base is oriented on a latitudinal circumference parallel to the equator. The second hemisphere has spherical substantially triangular second flicker regions of the first color with a second non-flicker region of the second color oriented between the second flicker regions. Each second flicker region has two congruent sides and a base, and the base is oriented on a latitudinal circumference parallel to the equator.

In yet another aspect, the present invention is directed to a method for increasing visual acuity of a sporting ball. The method includes selecting a graphic configured to create flicker peripherally noticeable when the ball is in play. Additionally, in this aspect, the method includes associating the graphic with a first color and associating a casing of the soccer ball with a second color. In this aspect, the method further includes positioning the graphic on the casing of the soccer ball.

Having briefly described an overview of embodiments of the present invention, an exemplary sporting ball with enhanced visual acuity is described below.

Referring to the drawings in general and FIGS. 1-8, in particular, an exemplary sporting ball with enhanced visual acuity is depicted in various views. Throughout this specification, as previously stated, the term sporting ball is intended to include various types of sporting balls including, but not limited to, soccer balls, baseballs, tennis balls, basketballs, racquetballs and the like. The depictions in the drawings are for exemplary purposes only and are in no way meant to limit the scope of the present invention to any particular type of ball or any particular ball configuration. Further, the materials used to create the sporting balls with enhanced visual acuity, as well as the material properties of the paint or dye used to color the sporting balls are well known in the art and will not be discussed in further detail herein.

Referring now to FIG. 1, a profile view of a sporting ball with enhanced visual acuity, including one hemisphere, in accordance with an embodiment of the present invention is illustrated and designated generally as reference numeral 100. Sporting ball 100 includes an exterior 102, a pole 104, a hub section 106, and spokes 108. As will be understood and appreciated by one of ordinary skill in the art, exterior 102 can be dyed, coated, constructed of appropriately colored materials, or otherwise colored using various spectral reflectances to be peripherally noticeable to players when the sporting ball is in use. The dye, coating, or other coloring may include various combinations, including, but not limited to, a combination of black and white, a combination of complementary colors, and a combination of color with specific spectral properties for increased visibility. Examples of color selections that may be used in accordance with the present invention are described in detail below in conjunction with FIGS. 10A-17, although other color combinations beyond those described may be used. Various color combinations are contemplated and within the scope of the present invention and, therefore, embodiments of the present invention are not limited to a particular color scheme. In various embodiments, the sporting ball will contain generally two colors, a dark color and a light color. Additional colors may, however, be used for graphics (for example identifying the manufacturer of the ball, the league using or authorizing the ball, etc.). Moreover, more than two colors may be used to enhance the visibility of a ball in accordance with the present invention. Those of ordinary skill in the art will understand and appreciate that luminance may be important to the visibility of the sporting ball. Luminance may be particularly important when the sporting ball is used at night, under stadium lights. Thus, by way of example, without limitation, various embodiments of the present invention may include a dark portion that is less than the light portion such that the luminance of the sporting ball remains high. For example, without limitation, in various embodiments of the present invention, the dark portion may be less than forty percent of the entire surface area of the sporting ball.

Exterior 102 can be any type of material for use in a sporting ball and has a substantially spherical surface including a pole 104, another pole (not shown) and an equator (not shown). On the exterior, there is a hub section 106. Extending from hub section 106 spherically and outwardly on exterior 102 are spokes 108. As illustrated in the exemplary FIG. 1, there are three spokes 108 extending from hub section 106 centered at pole 104 spherically and outwardly toward the equator (not shown) of exterior 102. Embodiments of the present invention, however, are not limited to any particular hub and spoke arrangement. For example, without limitation, there may be various numbers of spokes 108 extending from hub section 106

As will be understood and appreciated by one of ordinary skill in the art, hub section 106 and spokes 108 may have a first color and the rest of exterior 102 may have a second color. However, one skilled in the art will appreciate that different spokes may have different colors, and that even individual spokes may have more than one color. One skilled in the art will further appreciate that the rest of exterior 102 may comprise regions of differing colors. Also, one skilled in the art will realize that insignias and/or other designs having any color or combination of colors may be placed any where on the surface of a sporting ball in accordance with the present invention. As previously stated, various color configurations are contemplated and within the scope of the present invention. In various embodiments, by way of example, hub section 106 and spokes 108 may be part of a first exterior region and may be a graphic of a first color that is painted onto an exterior 102 with a second color. In various other embodiments, hub section 106 and spokes 108 may be the original color of exterior 102 and the second exterior region may be a graphic of a second color painted onto exterior 102. Further, in various embodiments, hub section 106 and spokes 108 may be dyed or colored onto exterior 102. Also, hub section 106 and spokes 108 may be constructed of a first material having a first color and the rest of exterior 102 may be constructed of a second material having a second color, with the first material and the second material joined by stitching, glue, or any other way. One of ordinary skill in the art will understand and appreciate that there exist various means for providing a first color section and a second color section on a sporting ball. Therefore, various available color schemes and various means for placing color on a sporting ball will not be discussed in more detail herein. Rather, the remainder of the discussion will focus on the arrangement of the graphics on the sporting balls and the optical properties produced by those arrangements when the sporting ball is in use.

In various embodiments of the present invention, hub section 106 and spokes 108 may be arranged to create a "flicker" when sporting ball 100 is rotated. Flicker is created by dark areas and light areas on a sporting ball such that when the ball is rotated there appears, to a sports player, flashes between dark and light on the surface of sporting ball 100. These flashes, or flickers, are noticeable to a player's peripheral and direct vision (although, as will be understood and appreciated by one of ordinary skill in the art, peripheral vision is better able to notice motion such as flicker). The dark and light areas of the sporting ball may be large enough so that they are not "blurred" when the ball is spinning at a high rotation per minute ("RPM") (e.g., if the regions were small black and white regions they will appear gray when spinning RPM with the threshold RPM beyond a given level at which blurring begins depending upon the sizes of the regions on the ball). Yet, the dark and light areas should be small enough that a significant flicker is created when the ball is spinning in normal sporting use (e.g., if the regions were too large and spaced too far, a player may not notice a flicker at all). The graphical arrangements of various embodiments of the present invention discussed herein overcomes problems that can occur if the graphic regions on a sporting ball are solid rings. Where the sporting ball is spinning on an axis passing through the center of the rings, a player would not notice any flicker and, thus, the player would not be able to sense the sporting ball's motion. Or, where the graphic regions are rings and the sporting ball is spinning on an axis passing near, but not through, the center of the rings, the sporting ball may appear "wobbly" to a player because the rings will be spinning off-center. Thus, embodiments of the present invention discussed in more detail herein are directed to various arrangements of graphics, such as hub section 106 and spokes 108, that create significant flicker enhancing visual acuity in a wide variety of orientations.

The foregoing discussion is included for exemplary purposes only, and is intended to provide the reader with a context for the various utilities of embodiments of the present invention. In no way is this exemplary utility overview meant to be limiting, as various other utilities not specifically identified are contemplated and within the scope of the present invention. Having provided a general overview of some components and utilities of sporting ball 100 with reference to FIG. 1, various other views and descriptions of various embodiments of the present invention are provided with reference to FIGS. 2-8 for descriptive purposes.

Figure 2:
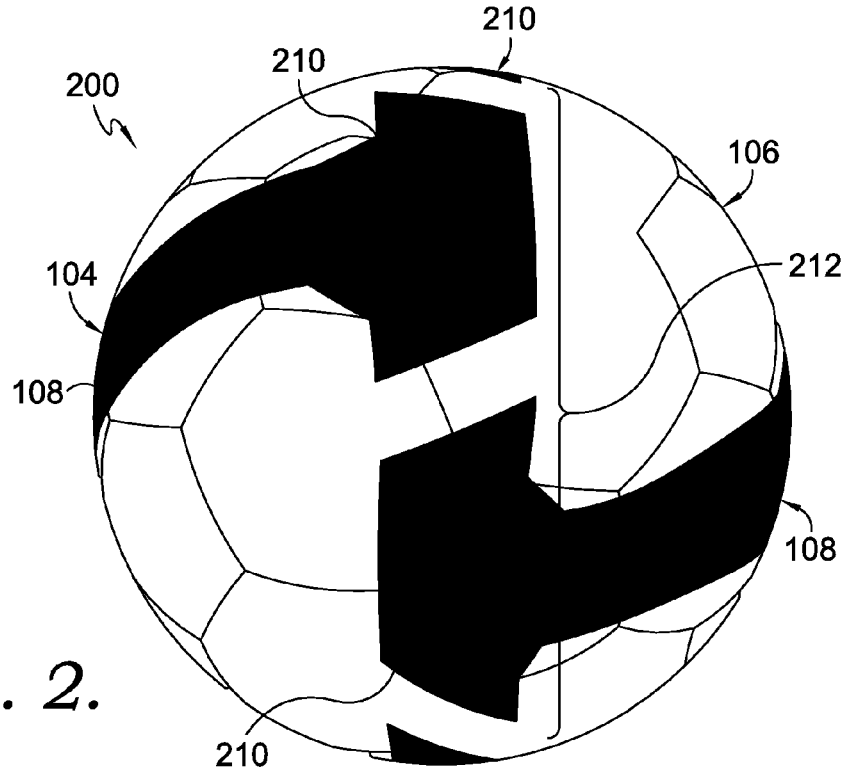
FIG. 2 is a profile view of a sporting ball with enhanced visual acuity, including portions of two hemispheres and the equator extending vertically, in accordance with an embodiment of the present invention.

Referring now to FIG. 2, a profile view of a sporting ball with enhanced visual acuity, including portions of two hemispheres and the equator extending vertically, in accordance with an embodiment of the present invention, is illustrated and designated generally as reference numeral 200. As will be understood and appreciated by one of ordinary skill in the art, sporting ball 200 represents a view in which sporting ball 100 has been rotated ninety degrees left along a vertical axis. Sporting ball 200 includes poles 104, spokes 108, hammers 210, and an equator 212. As will further be understood and appreciated by one of ordinary skill in the art, sporting ball 200 has an equator 212 (here appearing vertically) extending circumferentially around a center portion. The equator divides sporting ball 200 into two hemispheres (here appearing on the left and right of the equator peaking at poles 104). As will be understood and appreciated with reference to FIG. 2, a first set of spokes 108 extends from a hub section (not shown) at each pole 104 toward equator 212. Thus, in various embodiments, there are two sets of hub sections (not shown) and spokes 108, one set on each hemisphere of sporting ball 200. Hammers 210 are attached to each spoke at its peripheral end. In various embodiments, without limitation, hammers 210 may be centered on equator 212 such that hammers 210 from spokes 108 on the first hemisphere align on equator 212 with hammers 210 from spokes 108 on the second hemisphere.

Figure 3:
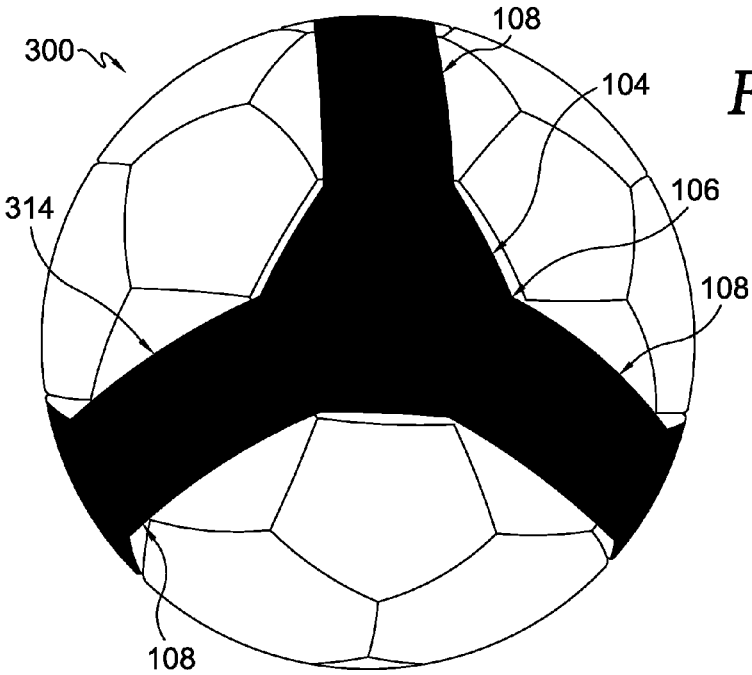
FIG. 3 is a profile view of a sporting ball with enhanced visual acuity, including one hemisphere, the hemisphere opposing the hemisphere of FIG. 1, in accordance with an embodiment of the present invention.

Referring now to FIG. 3, a profile view of a sporting ball with enhanced visual acuity, including one hemisphere, the hemisphere opposing the hemisphere of FIG. 1, in accordance with an embodiment of the present invention, is illustrated and designated generally as reference numeral 300. As will be understood and appreciated by one of ordinary skill in the art, sporting ball 300 represents a view in which sporting ball 200 has been rotated ninety degrees left along a vertical axis. Sporting ball 300 includes pole 104, hub section 106, and spokes 108. Spokes 108 have a width 314. Width 314 is adjustable and, in various embodiments, without limitation, width 314 may include various sizes based upon the desired flicker and luminance characteristics of sporting ball 300. For example, in various embodiments, without limitation, width 314 may be within a range between 37 and 40 millimeters on a standard sized American soccer ball, which have a circumference of between 68 and 70 centimeters. This range is meant for exemplary purposes and by no way limits the scope of the present invention to any particular width 314. Rather various sizes of width 314 are contemplated and within the scope of the present invention. For example, smaller sized balls are often used for youth play, and such balls could employ a visual design in accordance with the present invention, and the dimensions of the design in such an instance may optionally be adjusted based upon the different dimensions of the youth ball and/or the different ball speeds, ball RPMs, and/or environmental conditions experienced in youth play (or at a given level of youth play). Similarly, the present invention may be used in conjunction with balls for use in other sports, with alterations in the exemplary design described herein being made based upon ball size, ball shape, ball speed, ball RPMs, environmental conditions in which the sport is played, and other considerations.

Figure 4:
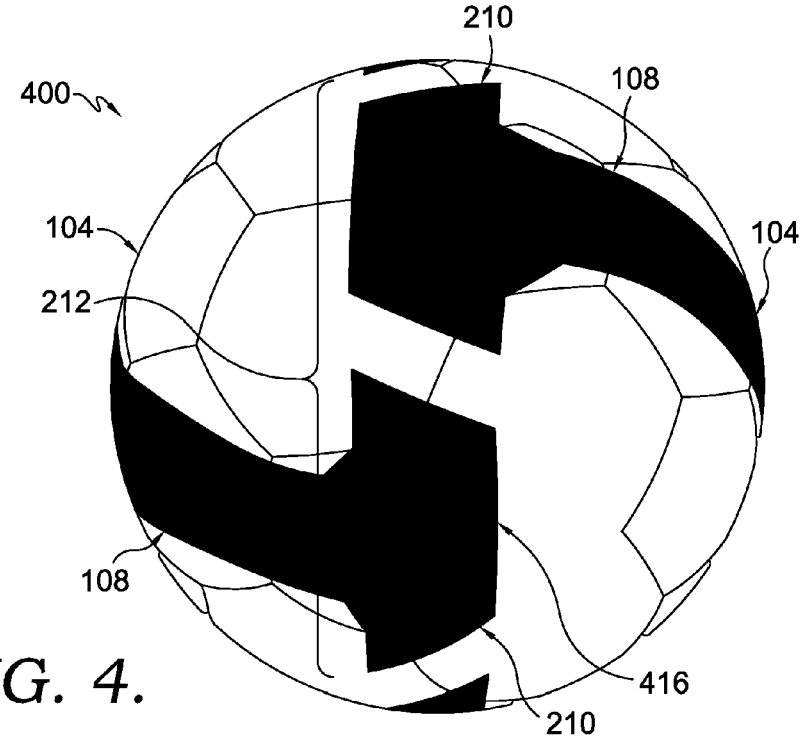
FIG. 4 is a profile view of a sporting ball with enhanced visual acuity, including portions of two hemispheres and the equator extending vertically, opposite the view of FIG. 2, in accordance with an embodiment of the present invention.

Referring now to FIG. 4, a profile view of a sporting ball with enhanced visual acuity, including portions of two hemispheres and the equator extending vertically, opposite the view of FIG. 2, in accordance with an embodiment of the present invention, is illustrated and designated generally as reference numeral 400. As will be understood and appreciated by one of ordinary skill in the art, sporting ball 400 represents a view in which sporting ball 300 has been rotated ninety degrees left along a vertical axis. Sporting ball 400 includes poles 104, spokes 108, hammers 210 and equator 212. In various embodiments, without limitation, spokes 108 extending from a first hub section (not shown) in the left hemisphere are offset on the equator from spokes 108 extending from a second hub section (not shown) in the right hemisphere. Stated differently, when rotating the ball, the peripheral end of one of spokes 108 does not abut a peripheral end of another of spokes 108. Instead, as will be understood and appreciated by one of ordinary skill in the art, the peripheral ends of the spokes abut a second exterior region of a second color (e.g. at 416). Considered in another context, in various embodiments, without limitation, hub sections 106 and spokes 108 form two 'Y' configurations, each 'Y' configuration centered on a pole of the sporting ball 400. In various embodiments, the 'Y' configurations are offset so that no branch of the first 'Y' configuration touches a branch of the second 'Y' configuration at the equator where the spokes 108 have a peripheral edge. As will be understood and appreciated by one of ordinary skill in the art, the configuration in these various embodiments allows for sporting ball 400 to create flicker when rotated along any axis because there is always an intersection portion with another color. Stated differently, in this embodiment at no point on sporting ball 400 can the first color be traced around the entire ball and at no point can the second color be traced around the entire ball.

Figure 5:
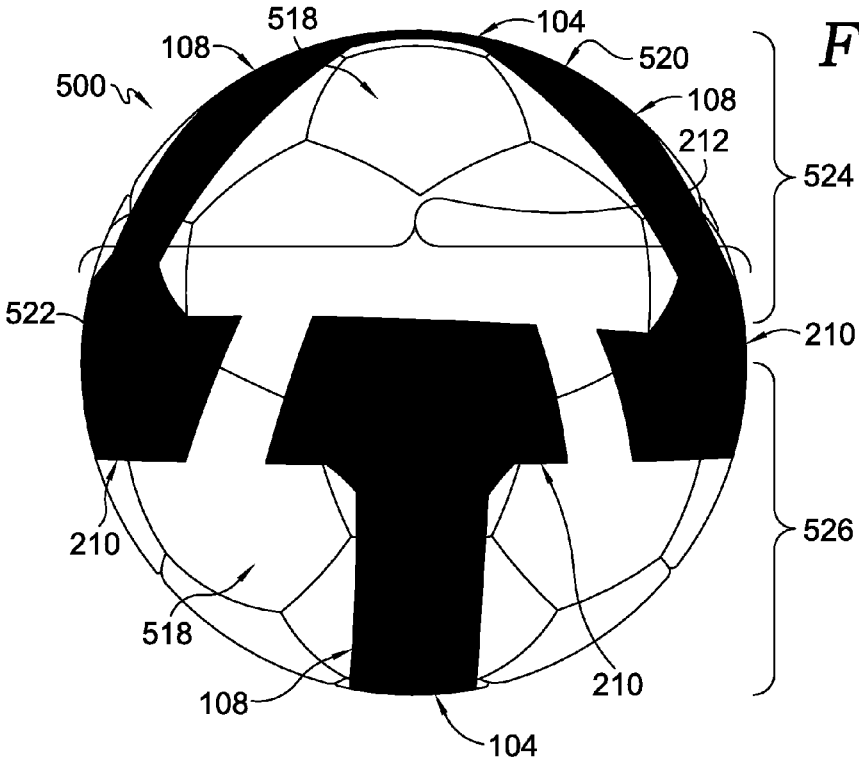
FIG. 5 is a profile view of a sporting ball with enhanced visual acuity, including portions of two hemispheres and the equator extending horizontally, in accordance with an embodiment of the present invention.

Referring now to FIG. 5, a profile view of a sporting ball with enhanced visual acuity, including portions of two hemispheres and the equator extending horizontally, in accordance with an embodiment of the present invention, is illustrated and designated generally as reference numeral 500. Sporting ball 500 includes poles 104, spokes 108, hammers 210, equator 212, flicker regions 518, and non-flicker regions 520. As will be understood and appreciated by one of ordinary skill in the art, non-flicker regions 520 may be the dark color regions including hub section (not shown), spokes 108, and hammers 210. Further, sporting ball 500 includes a casing 522. In FIG. 5, equator 212 is oriented horizontally, creating an upper hemisphere 524 and a lower hemisphere 526. Flicker regions 518 may be of a single color, but different colors may be used for different flicker regions 518, and different colors may even be used within a given flicker region 518. Similarly, different colors may be used for different non-flicker regions 520, and different colors may even be used within a given non-flicker region 520. Of course, insignias or other graphics having any color or combination of colors may be located anywhere on a ball in accordance with the present invention.

Figure 6:
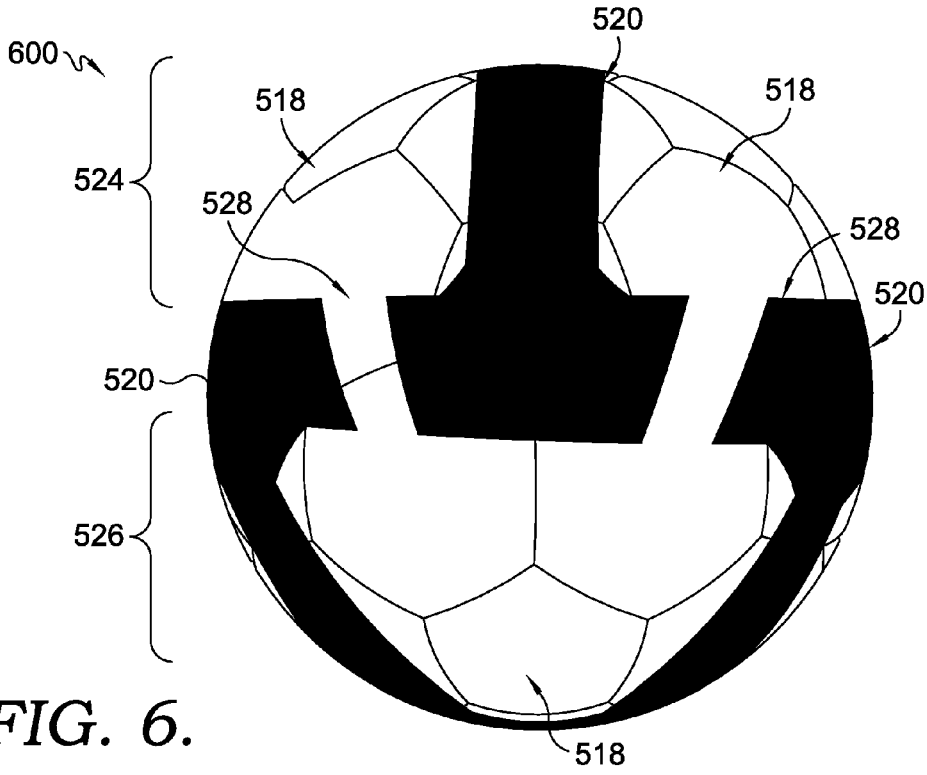
FIG. 6 is another profile view of a sporting ball with enhanced visual acuity, including portions of two hemispheres and the equator extending horizontally, slightly rotated from FIG. 5, in accordance with an embodiment of the present invention.

Referring now to FIG. 6, another profile view of a sporting ball with enhanced visual acuity, including portions of two hemispheres and the equator extending horizontally, slightly rotated from FIG. 5, in accordance with an embodiment of the present invention, is illustrated and designated generally with reference numeral 600. Sporting ball 600 includes flicker regions 518, non-flicker regions 520, upper hemisphere 524, lower hemisphere 526, equatorial flicker breaks 528, and an equatorial non-filter region 530. As will be understood and appreciated by one of ordinary skill in the art, in various embodiments, equatorial flicker breaks 528 are large enough such that when sporting ball 600 is rotated along a vertical axis in this view, players will be able to recognize flicker. Stated differently, flicker breaks 528 exist to ensure that neither the first color nor the second color appears entirely circumferentially around sporting ball 600. As stated above, there may always be an intersecting graphic when sporting ball 600 is rotated.

Figure 7:
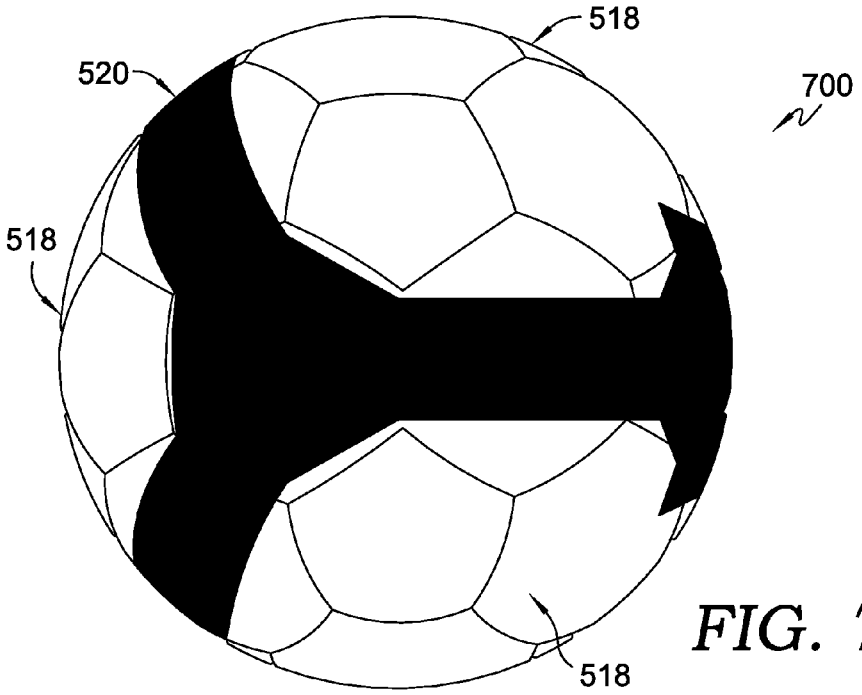
FIG. 7 is another profile view of a sporting ball with enhanced visual acuity, in accordance with an embodiment of the present invention.
Figure 8:
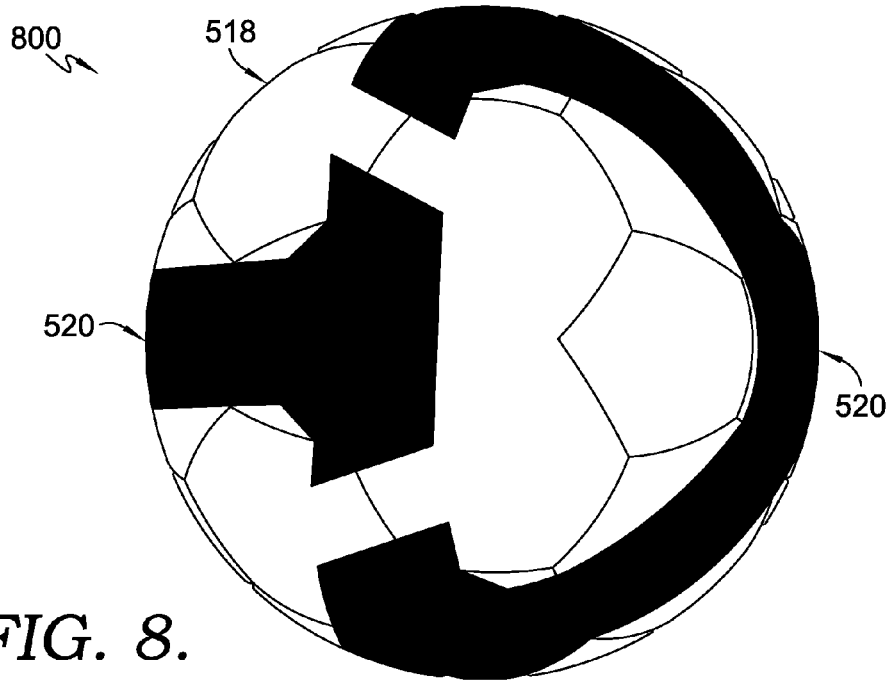
FIG. 8 is yet another profile view of a sporting ball with enhanced visual acuity, in accordance with an embodiment of the present invention.

Referring now to FIGS. 7 and 8, two more profile views of a sporting ball with enhanced visual acuity, in accordance with an embodiment of the present invention, are illustrated and designated generally with reference numerals 700 and 800. FIGS. 7 and 8 are provided as further illustrations of a sporting ball with enhanced visual acuity and include, by way of example, flicker regions 518 and non-flicker regions 520.

Figure 9:
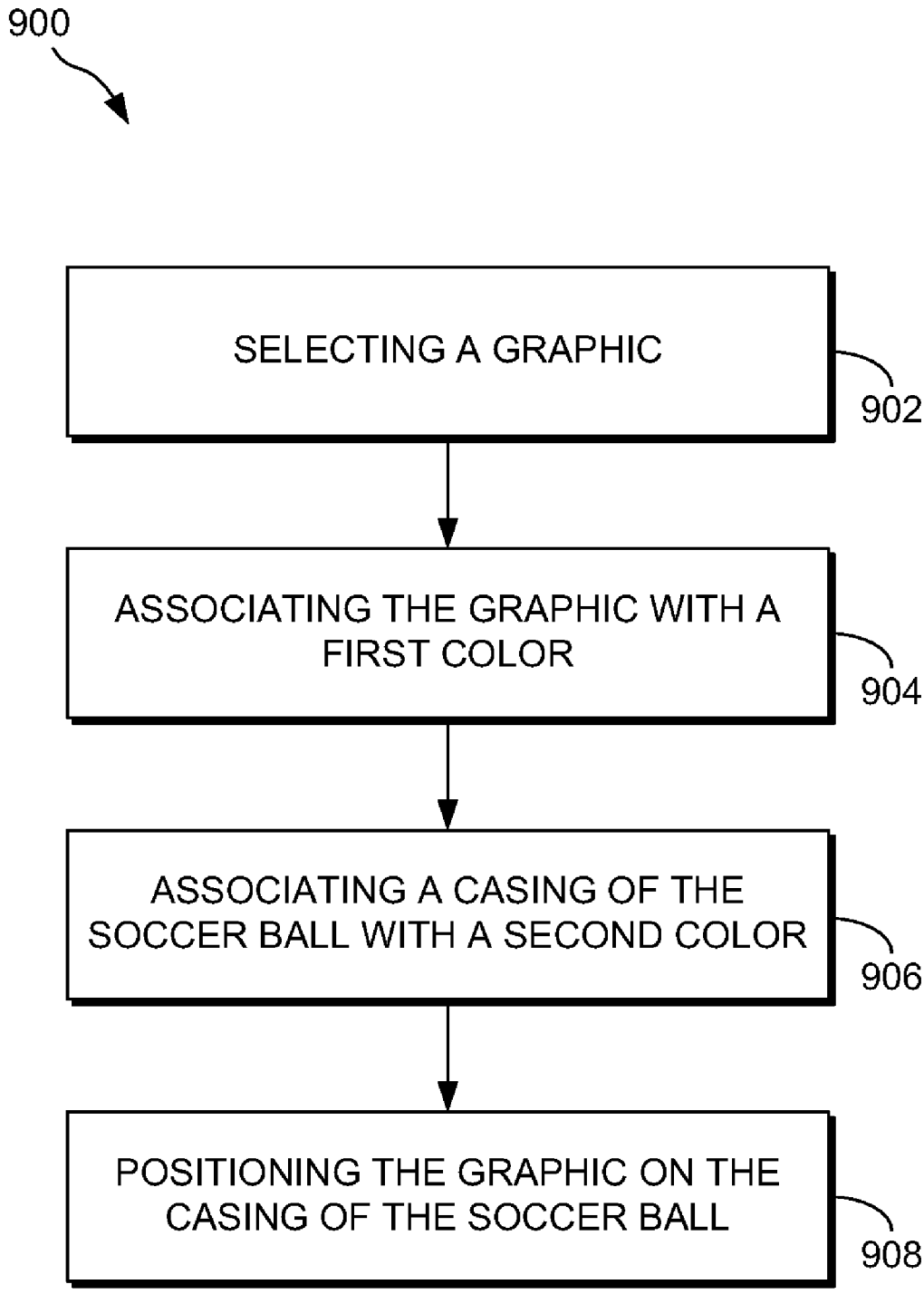
FIG. 9 is a flow diagram illustrating an exemplary method for enhancing visual acuity of a soccer ball, in accordance with an embodiment of the present invention.

Turning now to FIG. 9, a flow diagram illustrating an exemplary method for enhancing visual acuity of a sporting ball, in accordance with an embodiment of the present invention, is illustrated and designated generally as reference numeral 900. Initially, as indicated at block 902, a graphic is selected configured to create flicker peripherally noticeable when the ball is in play, e.g. like the graphics discussed previously with reference to FIGS. 1-8. As discussed above, in various embodiments, the graphic may be designed to enhance visual acuity of a ball by creating flicker. Additionally, in various embodiments, luminance is taken into consideration when selecting the graphic and, thus, the graphic may only be a percentage of the entire surface are of a sporting ball. For instance, without limitation, in various embodiments the graphic is 40 percent or less of the entire surface area of a sporting ball.

Next, as indicated at blocks 904 and 906, the graphic is associated with a first color and the casing of the ball is associated with a second color. As discussed above, in various embodiments the first color may be substantially black and the second color may be substantially white, or colors may be selected as described below in conjunction with FIGS. 10A-17, or any other color combination may be used. Embodiments of the present invention, however, are not limited to a specific color scheme. For instance, without limitation, the first color may be a color complementary to the second color.

Next, as indicated at block 908, the graphic is positioned on the casing of the ball. As previously stated, embodiments of the present invention are not limited to any particular means of coloring a sporting ball. For example, in various embodiments the graphic may be painted onto the casing of a sporting ball. In various other embodiments dyes or coatings may be used. Various ways of positioning the graphic on the ball are contemplated and within the scope of the present invention.

One skilled in the art will appreciate that any of steps 902, 904, 906, and 908 may be repeated to place additional graphics on a ball, and that these graphics may have different shapes, sizes, and/or colors than those established in an earlier iteration of method, 900. However, the iteration of steps of method 900 is not required in accordance with the present invention. Further, additional graphics and/or insignia may optionally be placed on the surface of a ball without departing from the scope of the present invention.

In each of the exemplary methods described herein, various combinations and permutations of the described blocks or steps may be present and additional steps may be added. Further, one or more of the described blocks or steps may be absent from various embodiments. It is contemplated and within the scope of the present invention that the combinations and permutations of the described exemplary methods, as well as any additional or absent steps, may occur. The various methods are herein described for exemplary purposes only and are in no way intended to limit the scope of the present invention.

Figure 10A:
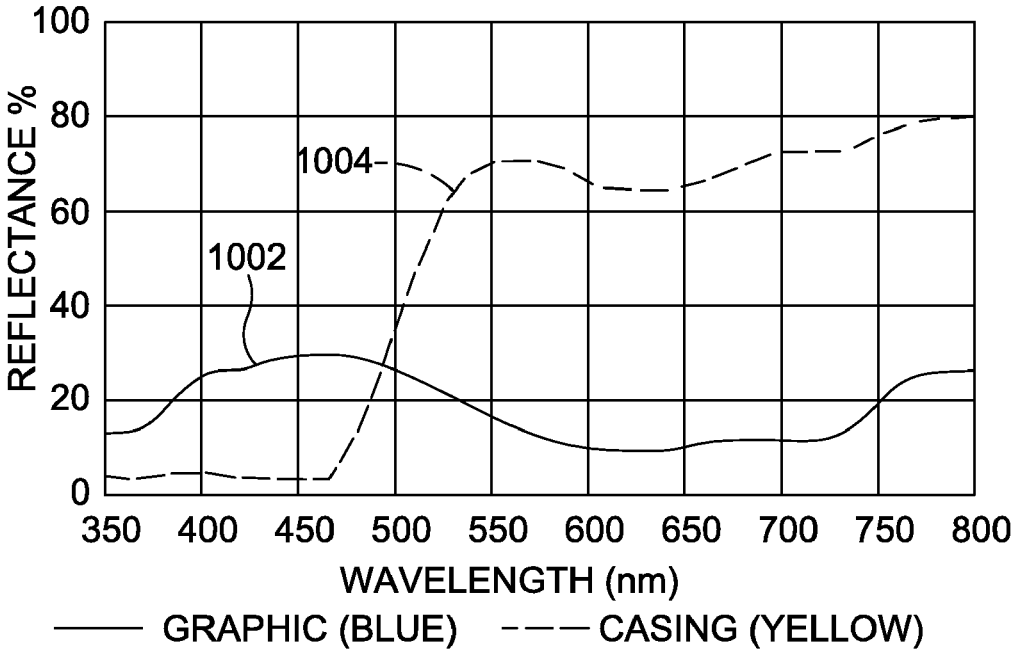
FIG. 10A is a graph of casing reflectance and graphic reflectance as functions of wavelength for a representative color selection for a soccer ball in accordance with the present invention.
Figure 10B:
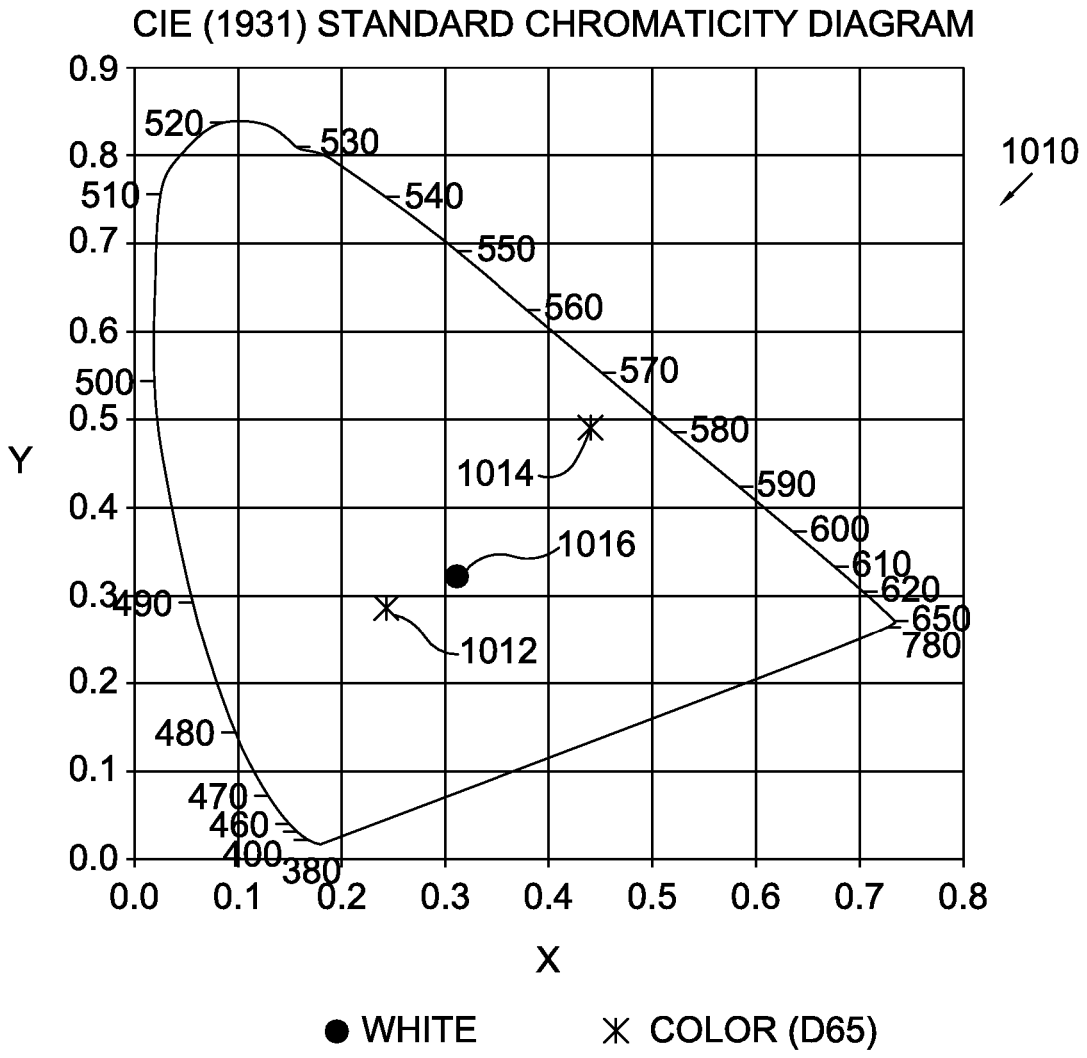
FIG. 10B is a graph illustrating CIE color coordinates associated with the reflectances of FIG. 10A as illuminated by bright sunlight.
Figure 10C:
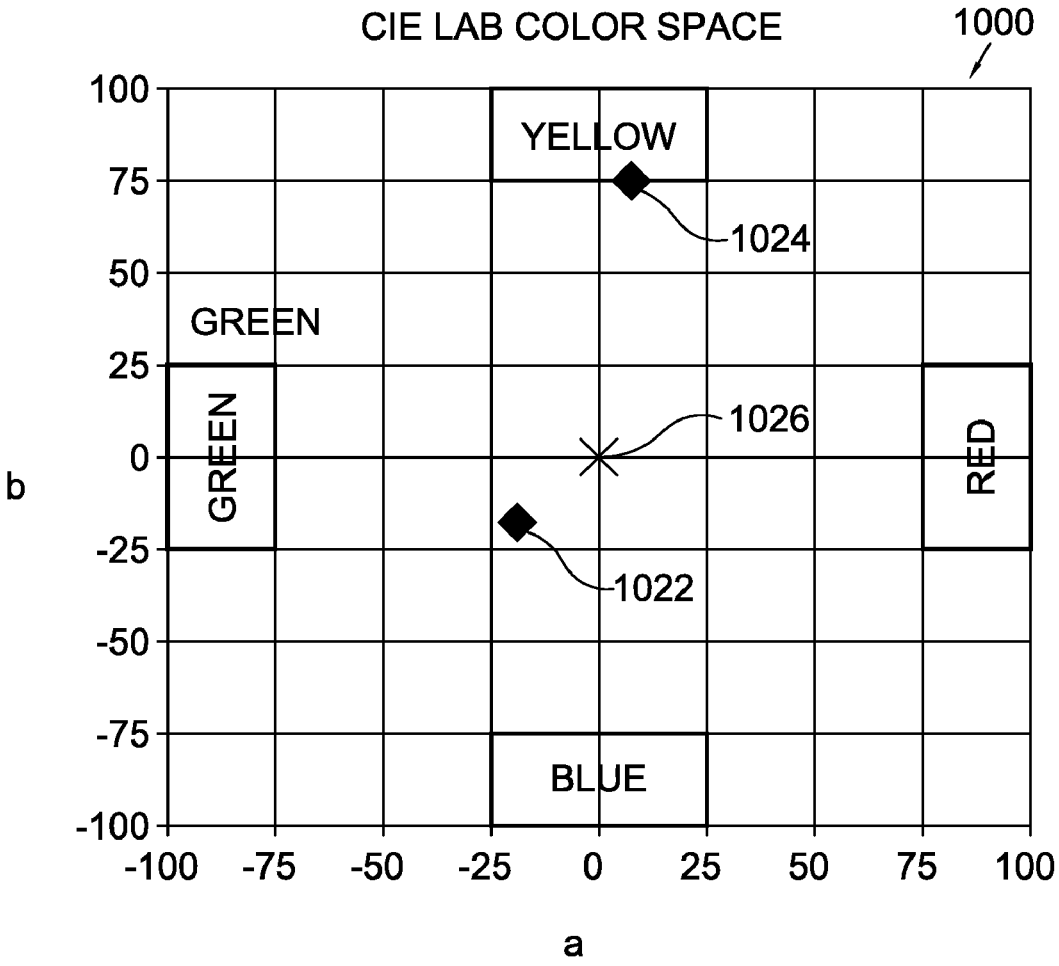
FIG. 10C is a graph illustrating CIE L-a-b color coordinates associated with the color coordinates of FIG. 10B.

A representative selection of visibility-enhancing coloration for a soccer ball in accordance with the present inventions illustrated in FIGS. 10A-10C. Referring to FIG. 10A, a graphic reflectance 1002 and a casing reflectance 1004 are selected that appear blue and yellow, respectively. Alternatively, purple may be used in addition to or in place of blue. CIE X-Y coordinate locations 1012, 1014 associated with the graphic reflectance and the casing reflectance, respectively, as illuminated by sunlight are shown in a CIE standard chromaticity diagram 1010 in FIG. 10B. For reference, a location 1016 of a standard white (sunlight or illuminate D65) is also shown. The CIE Z-coordinate that is associated with a total reflectance or luminance is not shown on the chromaticity diagram 1010. The locations 1012, 1014 are widely separated and are opposite with respect to the location 1016. CIE L-a-b color coordinates associated with the reflectances 1002, 1004 are shown in FIG. 10C as locations 1022, 1024, respectively on a L-a-b representation 1020. The locations 1022, 1024 are widely separated and opposite with respect to a location 1026 associated with white illumination, but in other examples, colors associated with color coordinates that are not opposite with respect to the location 1026 can be used. In FIG. 10C, an L-a-b luminance coordinate L is not shown.

Color selection and characterization can be conveniently described based on a CIE L-a-b Color Space. A Total Color Difference (TCD) between colors having coordinates ($L_1$, $a_1$, $b_1$) and ($L_2$, $a_2$, $b_2$) in such a color space can be defined as $TCD=\sqrt{(a_1-a_2)^2+(b_1-b_2)^2+(L_1-L_2)^2}$. A Color Difference (CD) under isoluminant conditions, i.e., assuming identical brightnesses of the colors, can be defined as $CD=\sqrt{(a_1-a_2)^2+(b_1-b_2)^2}$. In a CIE Lab Color Space, complementary colors can be associated with color coordinates along any axis that passes through or near a central "white" point. Horizontal, vertical, or other axes can be used. For example, a vertical axis is associated with blue/yellow, a horizontal axis is associated with red/green, and oblique axes through opposite corners of an L-a-b coordinate systems are associated with orange/blue-green and purple/green-yellow. Luminance contrast be calculated using a spectral reflectance function SRF(λ) (reflectance as a function of wavelength λ) of an object with respect to a particular light source. For the examples presented herein, a light source having a spectral distribution D65(λ) and similar to sunlight is used. In addition, a human spectral sensitivity function HSSF(λ) is used. Object luminance coordinate L can be calculated as:

$$L=\frac{\int SRF(\lambda)D65(\lambda)HSSF(\lambda)d\lambda}{\int D65(\lambda)HSSF(\lambda)d\lambda}.$$

Luminance contrast for objects having luminances $L_1$ and $L_2$ can be calculated as $|(L_1-L_2)/L_1|$, wherein $L_1>L_2$.

Color contrast can be associated with a distance between the locations 1022, 1024 on the L-a-b space representation 1020, and a color difference can be associated with a total distance between the locations 1022, 1024. For example, colors $C_1$ and $C_2$ that are associated with respective CIE L-a-b coordinates ($C1_L$,$C1_a$,$C1_b$) and ($C2_L$, $C2_a$, $C2_b$), can be associated with a color difference $CD=\sqrt{(C1_a-C2_a)^2+(C1_b-C2_b)^2}$, and in typical examples enhanced-visibility colors (EVCs) have color differences of greater than about 50, or greater than about 75, or greater than about 100. In other examples, a total color difference TCD between colors $C_1$ and $C_2$ is at least about 100, wherein $TCD=\sqrt{(C1_a-C2_a)^2+(C1_b-C2_b)^2+(C1_L-C2_L)^2}$. In additional examples, the substantially complementary colors have a luminance contrast of the first region and the second region of at least 50%. In other examples, color contrast can be associated with horizontal or other separations in an L-a-b representation.

Color differences associated with FIGS. 10A-10C are summarized in Table 1. CIE dominant wavelengths for the graphic and the casing reflectances of FIG. 10A are approximately 482 nm (blue) and 572 nm (yellow), respectively. However, the blue graphic may be replaced with a graphic having a reflectance at a shorter wavelength (i.e., purple) without departing from the scope of the present invention. Luminance contrast is about 70% and color difference (CD) is about 98. Total color difference (TCD) is about 103.

TABLE 1

Color coordinates associated with the spectral reflectances of FIG. 10A.

| Color Coordinates | Graphic (Faded Blue) | Casing (Greenish-Yellow) |
|---|---|---|
| x | 0.2394 | 0.4356 |
| y | 0.2646 | 0.4901 |
| z | 0.4960 | 0.0743 |
| L | 48.51 | 81.22 |
| a | −18.45 | 6.64 |
| b | −18.14 | 76.58 |

Selection of complementary colors for a soccer ball graphic and casing as described above can offer significant visual contrast, but such complementary color contrast can be further enhanced by selection of contrasting total reflectances that can be associated with luminance values of, for example, the graphic and the casing. In addition, selection of contrasting graphic/casing colors can provide aesthetically superior visual appearance of, for example, a soccer ball or other item. In addition, selection of these contrasting colors can be based on an anticipated use environment. For example, for a soccer ball that is to be used in matches played on natural grass pitches, colors are preferably selected to enhance mutual contrast between the ball and the grass patch. In other examples, contrast based on a different background such as blue sky, cloud cover, stadium seating, or other immediate surround to a playing surface such as trees, playground structures, or spectator clothing can be selected.

Figure 11A:
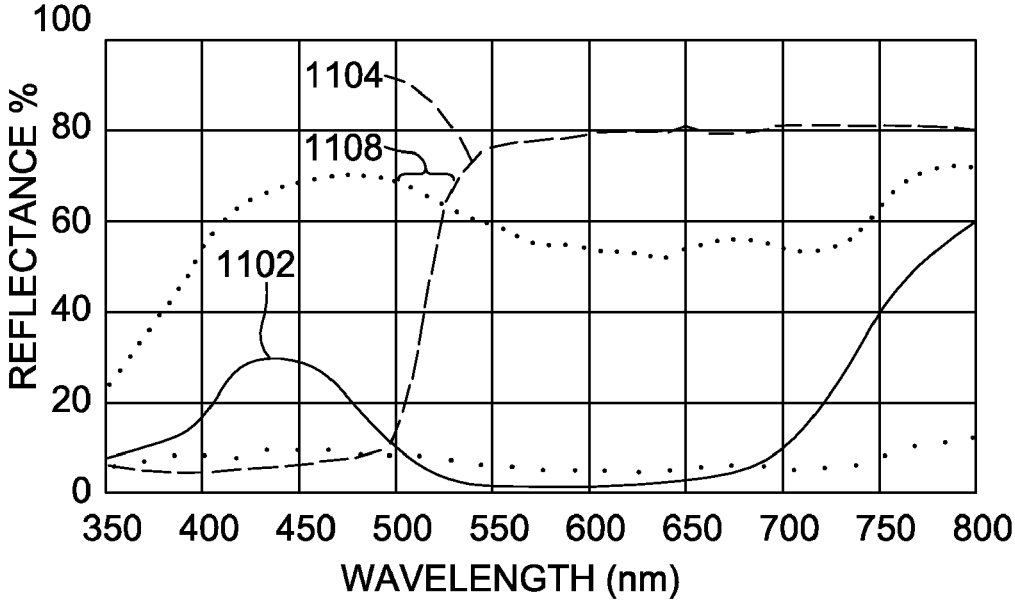
FIG. 11A is a graph of casing reflectance and graphic reflectance as functions of wavelength for a representative color selection of a soccer ball in accordance with the present invention.
Figure 11B:
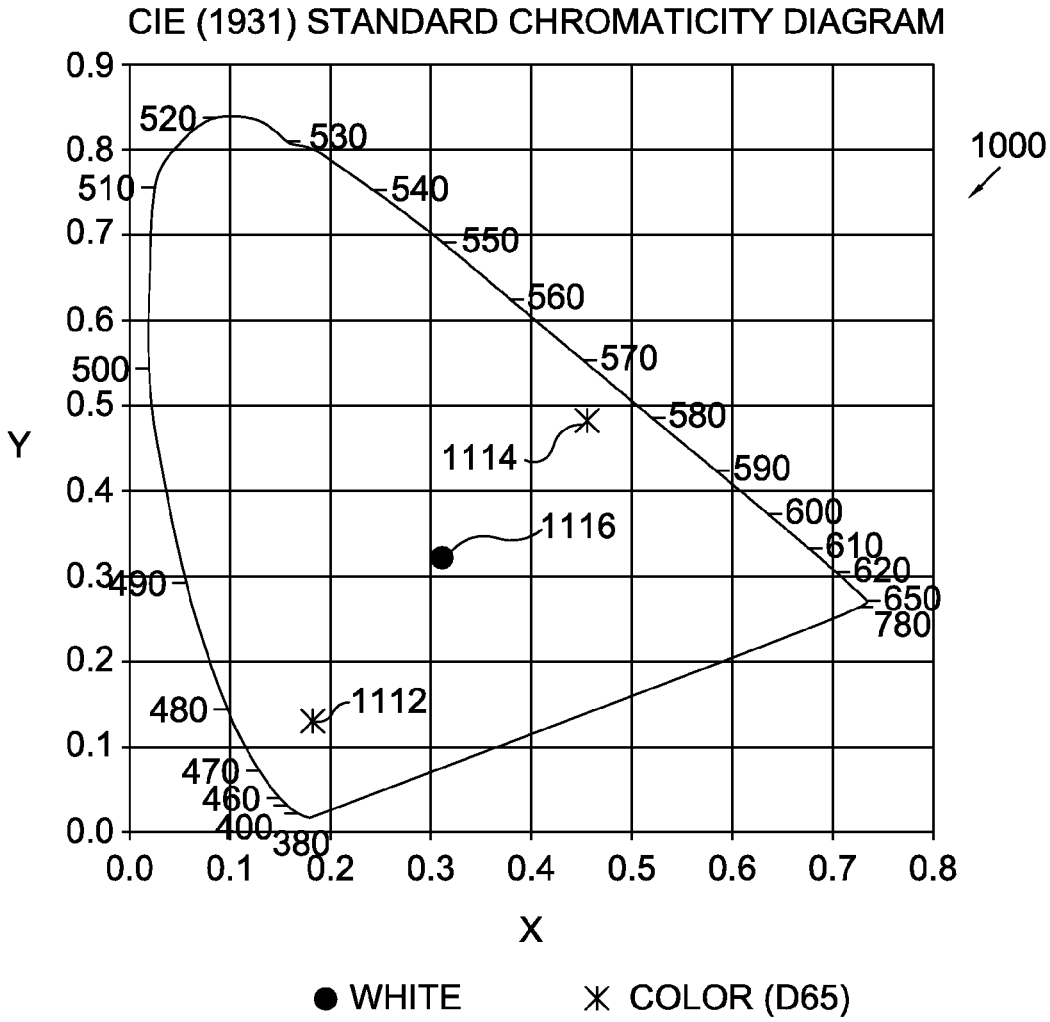
FIG. 11B is a graph illustrating CIE color coordinates associated with the reflectances of FIG. 11A as illuminated by bright sunlight.
Figure 11C:
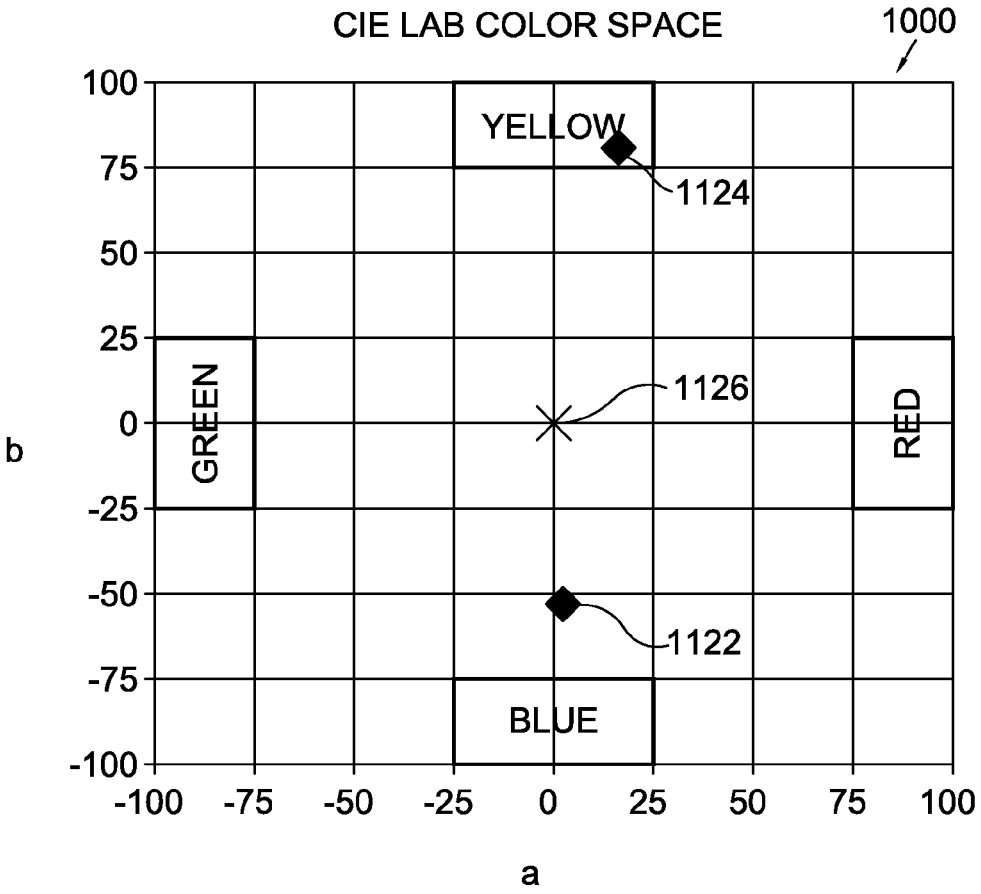
FIG. 11C is a graph illustrating CIE L-a-b color coordinates associated with the color coordinates of FIG. 11B.

A representative selection of visibility-enhancing coloration based on these additional considerations is illustrated in FIGS. 11A-11C. Referring to FIG. 11A, a graphic reflectance 1102 and a casing reflectance 1104 are selected that appear blue (or, alternatively, purple) and yellow, respectively. The reflectance curves 1102, 1104 are configured so that a spectral window 1108 is defined in which neither the graphic nor the casing of a soccer ball in accordance with the present invention have reflectances that are reduced. Typically such reduced reflectances are less than about 50%, 25%, or 10%. As shown in FIG. 11A, the spectral window 1108 is located in a spectral region associated with green to enhance the appearance of the ball on a typical green (grass) soccer pitch. CIE X-Y coordinate locations 1112, 1114 associated with the graphic reflectance and the casing reflectance, respectively, as illuminated in sunlight illumination are shown in a CIE standard chromaticity diagram 1110 in FIG. 11B. For reference, a location 1116 of a standard white illuminant (similar to sunlight) is also shown. The CIE Z-coordinate that is associated with total reflectance or luminance is not shown on the chromaticity diagram 1110. The locations 1112, 1114 are widely separated and are opposite with respect to the location 1116. CIE L-a-b color coordinates associated with the reflectances 1102, 1104 are shown in FIG. 11C as locations 1122, 1124, respectively. The locations 1122, 1124 are widely separated and opposite with respect to a location 1126 associated with white illumination. A luminance coordinate is not shown. Color contrast can be associated with a distance between the locations 1122, 1124 on the L-a-b space representation, and total color difference associated with a total distance between the locations 1122, 1124 including differences associated with L-a-b color space L-coordinates.

Color coordinates (x-y-z and L-a-b) based on the spectral reflectances of FIG. 11A are listed in Table 2. The CIE dominant wavelengths for the graphic and the casing are approximately 465 nm (blue) and 575 nm (yellow), respectively. However, the blue graphic may be replaced with a graphic having a shorter dominant wavelength (i.e., purple) without departing from the scope of the present invention. Luminance contrast is about 93% and color difference (CD) is about 134. Total color difference (TCD) is about 147.

TABLE 2

Color coordinates associated with the spectral reflectances of FIG. 3A.

| Color Coordinates | Graphic (Blue) | Casing (Yellow) |
|---|---|---|
| x | 0.1859 | 0.4559 |
| y | 0.1127 | 0.4771 |
| z | 0.7014 | 0.0670 |
| L | 24.78 | 84.03 |
| a | 0.41 | 17.11 |
| b | −52.29 | 80.63 |

Figure 12:
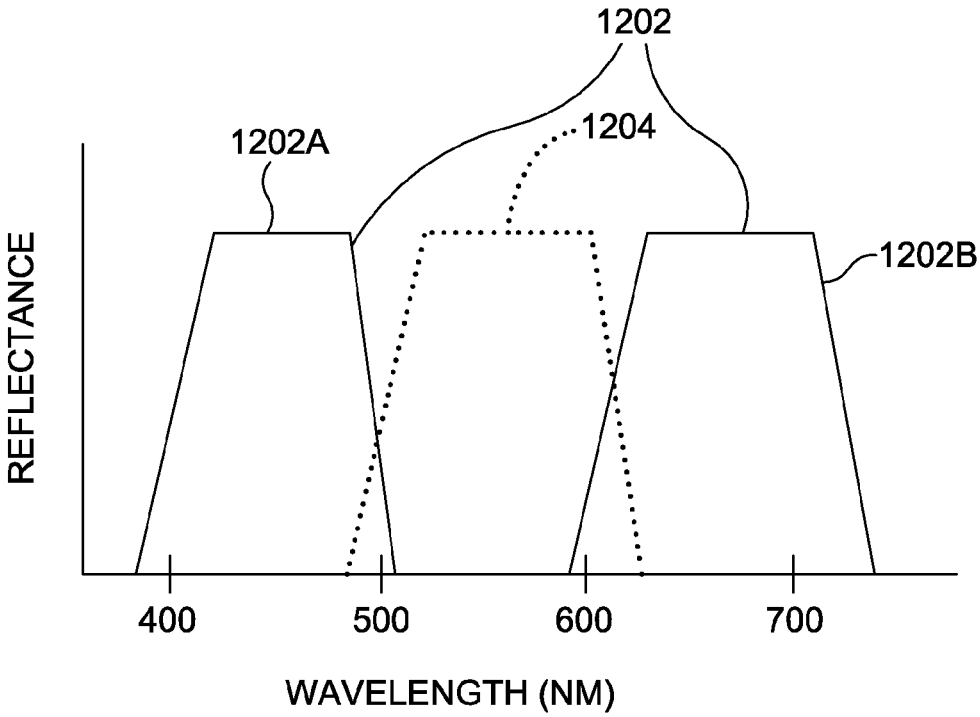
FIGS. 12-13 contain graphs of reflectance as a function of wavelength for additional representative examples of enhanced-visibility colors.
Figure 13:
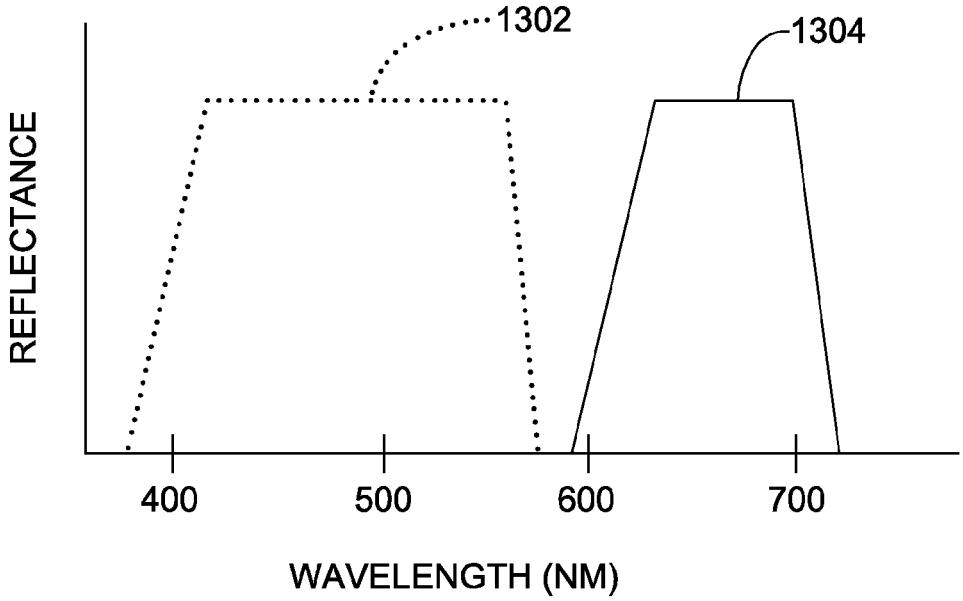
Figure 14:
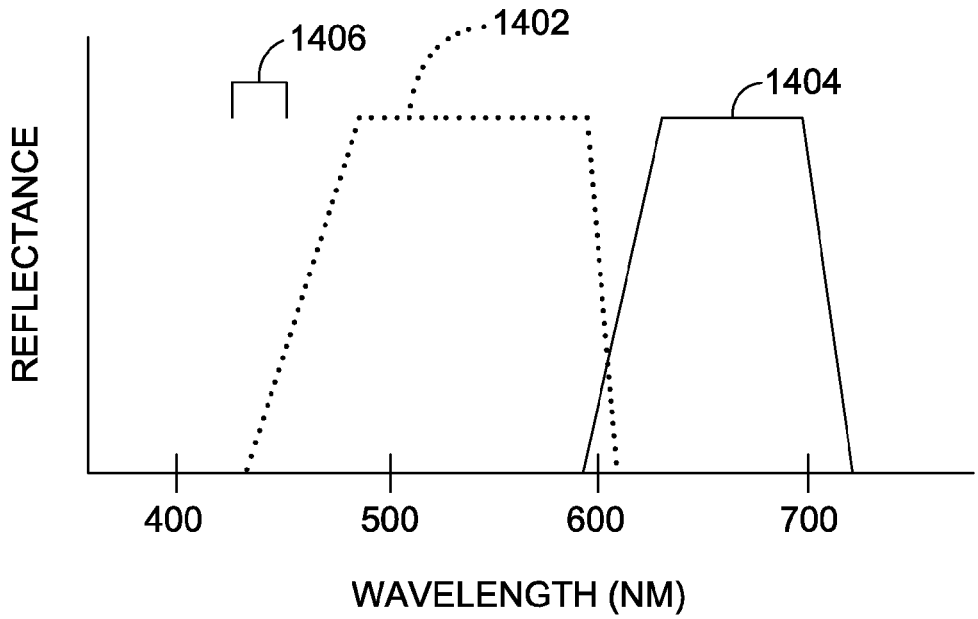
FIG. 14 contains graphs of reflectance as a function of wavelength for an additional representative example, wherein enhanced-visibility colors are selected based on a background spectrum.

Additional representative examples complementary spectral reflectances are illustrated in FIGS. 12-14. FIG. 12 illustrates spectral reflectances 1202, 1204 associated with magenta and green, respectively. The reflectance 1202 includes portions 1202A, 1202B associated with substantial reflectance values in blue and red wavelength ranges, respectively. Spectral reflectances such as the reflectances 1202, 1204 can be used to enhance visibility. FIG. 13 illustrates spectral reflectances 1302, 1304 associated with cyan and red, respectively. In this example, the spectral reflectances 1302, 1304 do not overlap in a spectral window at about 580 nm. This spectral window can be associated with a background such as a playing surface, or can be associated with spectral characteristics of selected coloring materials. Spectral reflectances such as the reflectances 1302, 1304 can also be used to enhance visibility. Additional suitable reflectances 1401, 1404 associated with blue and yellow, respectively, are shown in FIG. 14. The reflectances 1402, 1404 lack appreciable reflectivity at wavelengths less than about 450 nm and therefore appropriate for defining colors on a ball to be used against a blue background, although such colors can be used with other backgrounds as well. As used herein, appreciable reflectivity refers to reflectivities greater than about 20%, 50%, or 75%.

Graphic/casing colors associated with enhanced visibility can be selected to be substantially complementary or "opposing" as shown on a CIE plot. In some color representations, equal separations as graphed do not correspond to equal or even approximately equal perceived color differences. For example, so-called MacAdam ellipses of varying sizes and eccentricities can be used to characterize "just noticeable differences" (JND) in perceived colors as a function of coordinate location on the standard CIE chromaticity diagram. Representative methods for selecting enhanced visibility color combinations can be described with reference to FIG. 15A. For convenience, a length of a chromatic blend line 1505 connecting locations 1502, 1504 associated with selected enhanced visibility colors and extending to a CIE curve boundary 1507 can be referred to as a chromatic blend limit (CBL). The CBL is associated with an available color space. Colors can be selected so that the corresponding separations on a CIE graph are greater than about 90%, 75%, or 50% of the CBL.

Figure 15A:
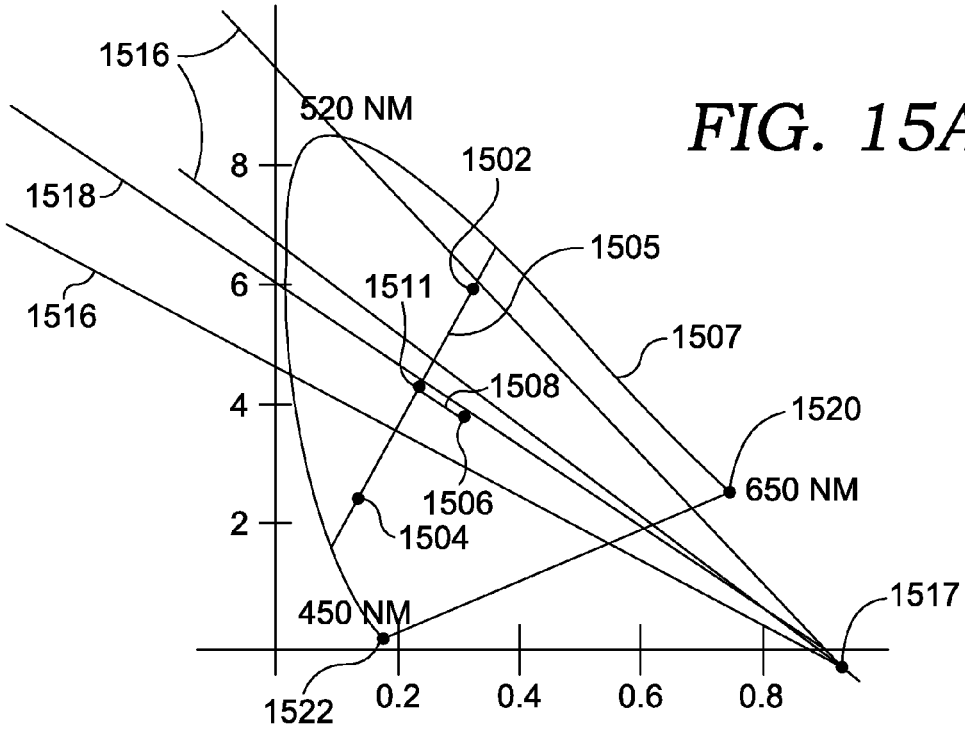
FIG. 15A is a diagram of a CIE chromaticity curve illustrating selection of enhanced-visibility colors.

In addition to selecting colors having a predetermined CIE color space separation, colors are generally selected to be substantially opposite with respect to a color space location 1506 perpendicular to the chromatic blend line 1505 is less than about 50%, 25%, 15%, or 10% of the CBL. In addition, selected colors on the chromatic blend line 705 are on opposite sides of an intersection 1511 of the chromatic blend line 1505 and the line 1508. Enhanced-visibility color sets of two or more colors can be similarly selected using other color space representations as well, and the representation of FIG. 15A is only one convenient representation.

Colors and combinations that are appropriate even for so-called color deficient individuals (commonly known as "color blind" individuals) can be similarly selected. Referring further to FIG. 15A, a series of color confusion lines 1516 associated with colors that are typically confused by individuals exhibiting deuteranopia or deuteranomaly extend from a deutan origin 1517. Color combinations along the lines 1516 are preferably avoided for such individuals. As is apparent, colors associated with the locations 1502, 1504 are well suited for such individuals as the chromatic mixing line 1505 connecting these points is approximately perpendicular to a deutan confusion line 1518 extending through the white point 1506. Such a confusion line can be referred to as a central confusion line so that the deutan confusion line 1518 can be referred to as a deutan central confusion line. Color confusion is generally avoided with chromatic blend lines are substantially perpendicular to a central confusion line, this is, that intersect central confusion lines at angles greater than 60 degrees, greater than 70 degrees, greater than 75 degrees, or greater than 80 degrees. In some examples, the angle of intersection is at least 85 degrees. In some examples, the angle of intersection is at least 85 degrees. While deutan (red-green color deficiency) is the most common form of color deficiency and is therefore desirably compensated in color selection, additional forms of color deficiency such as protan (red-green) or tritan (yellow-blue) color deficiency can be compensated using lines of confusion that originate from a protan origin 1520 or a tritan origin 1522, respectively.

Selected color coordinates can serve as a guide in dye or pigment selection, and actual ball colors can differ. For example, dyes that are satisfactory with respect to durability, cost, fading, or other factors may be unavailable. In addition, enhanced-visibility colors can be modified for aesthetic reasons to, for example, coordinate with player uniforms or team colors, or for other reasons. In some examples, actual colors deviate from associated target color coordinates to trade-off color vision correction, luminance contrast, or other design goals. Fluorescent agents can also be included to enhance overall ball luminance as well as to provide additional luminance at selected wavelengths.

Figure 15B:
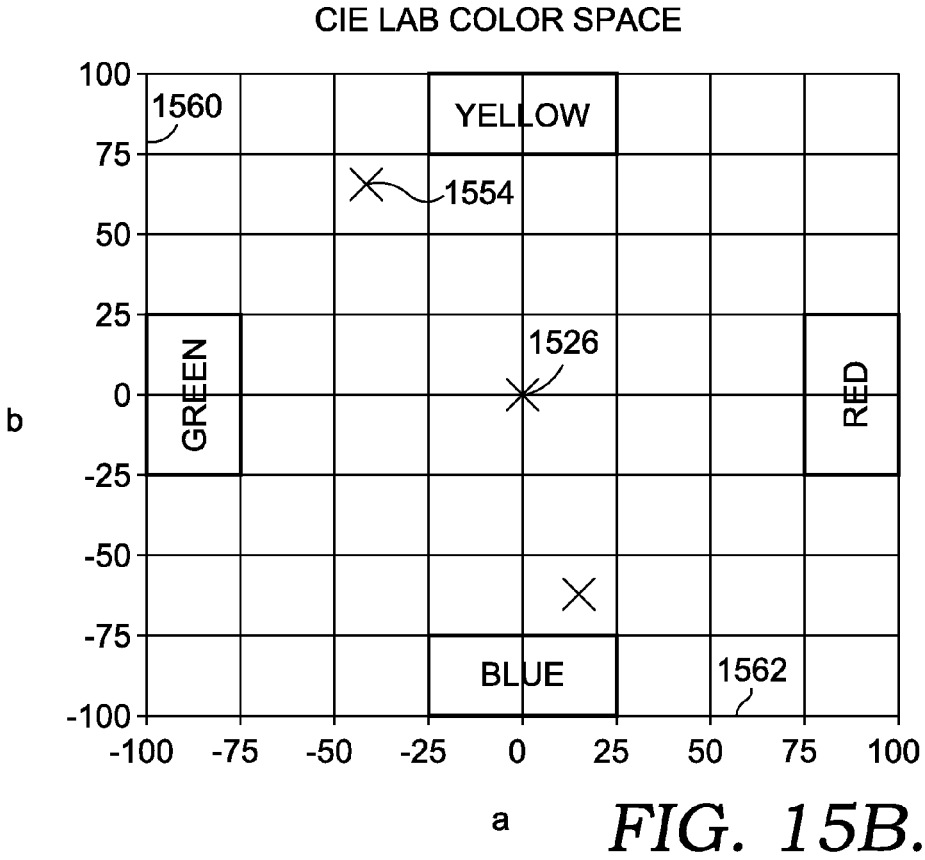
FIG. 15B is a diagram of a CIE L-a-b color space illustrating selection of enhanced-visibility colors.

CIE L-a-b coordinates can also be used in enhanced-visibility color (EVC) selection. Referring to FIG. 15B, locations 1532, 1554 can be associated with selected EVCs. For example, suitable EVC pairs such as the pair associated with the locations 1552, 1554 are defined by L-a-b locations that are separated along a b-axis 1560 by at least 50, 75, 100, 125, or 150 units. In some examples, at one location is associated with a negative b-value and one location is associated with a positive b-value. In other examples, locations are separated along an a-axis 1562 by at least 50, 75, 100, 125, or 150 units, and in particular examples, one location is associated with a negative a-value and one location is associated with a positive a-value. In other examples, a color difference (CD) is selected that is greater than about 50, 75, 100, 125, or 150 units without regard for a particular axis.

Figure 16:
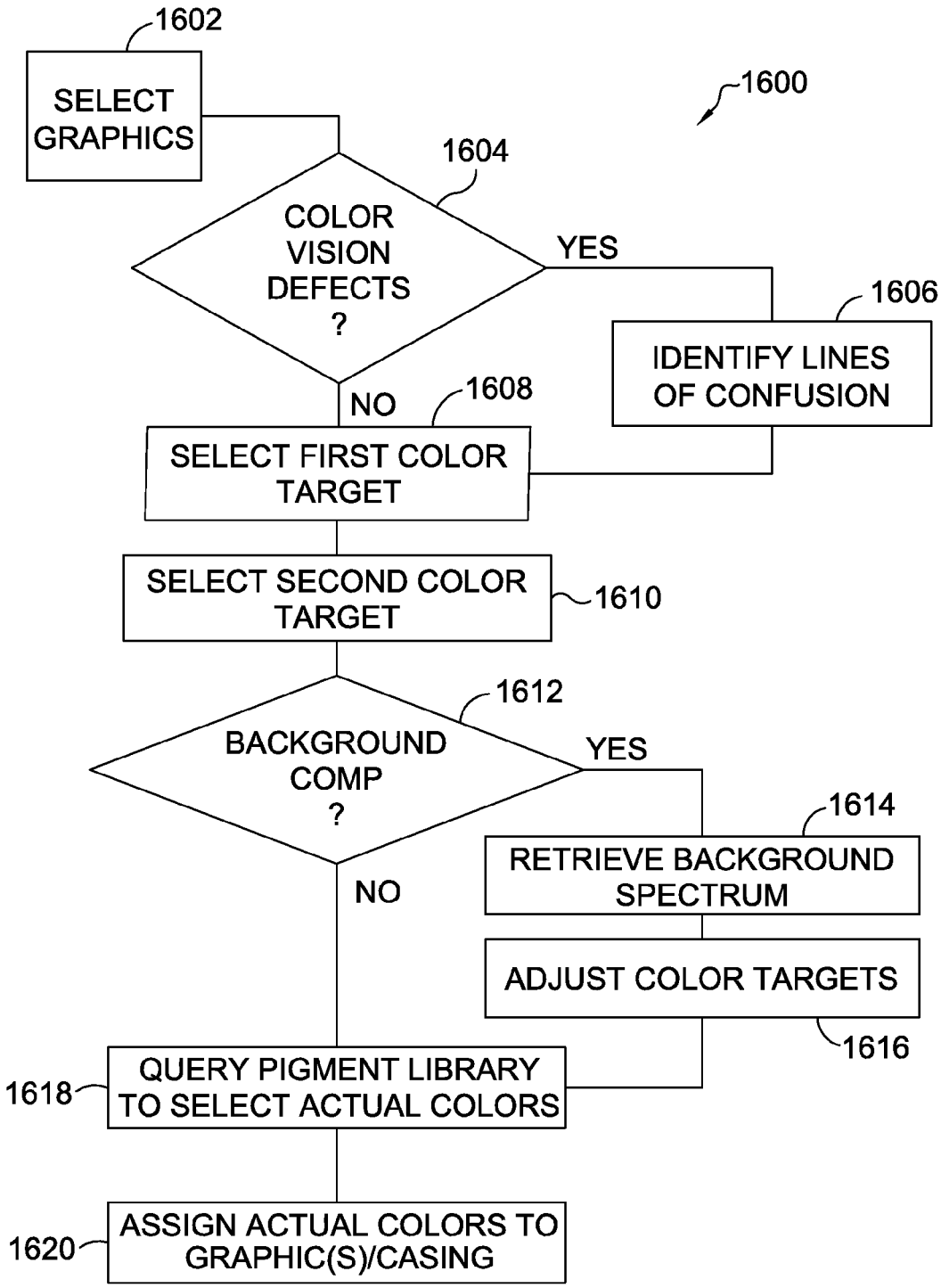
FIG. 16 is illustrates a representative method of selecting enhanced-visibility colors that can avoid color combinations associated with, for example, color confusion associated with a color deficiency.

With reference to FIG. 16, a representative method 1600 for selecting, for example, a casing color and a graphic color includes selecting or defining a graphic region and a casing region in a step 1602. In a step 1604, a determination of whether color selection is to include consideration of color vision defects is made. If, for example, avoidance of colors confused by some individuals due to a color deficiency is desired, lines of confusion can be identified in a step 1606 so that such colors can be identified or avoided. In other examples, colors and color combinations inappropriate for color deficient individuals can be identified in other ways. In steps 1608, 1610, first and second target colors are selected based on, for example, CIE coordinates as shown in FIGS.

7A-7B, or using another method. In a step 1612, a determination of whether a background such as grass, sky, clouds, or other background is to be considered is made. If so, a background spectrum is retrieved from a database in step 1614, and the first and second target colors are modified based on the background spectrum in a step 1616. A pigment library is queried in a step 1618, and pigments are assigned to, for example, a casing and a graphic in a step 1620. Alternatively, colors can be selected based on PANTONE colors.

Figure 17:
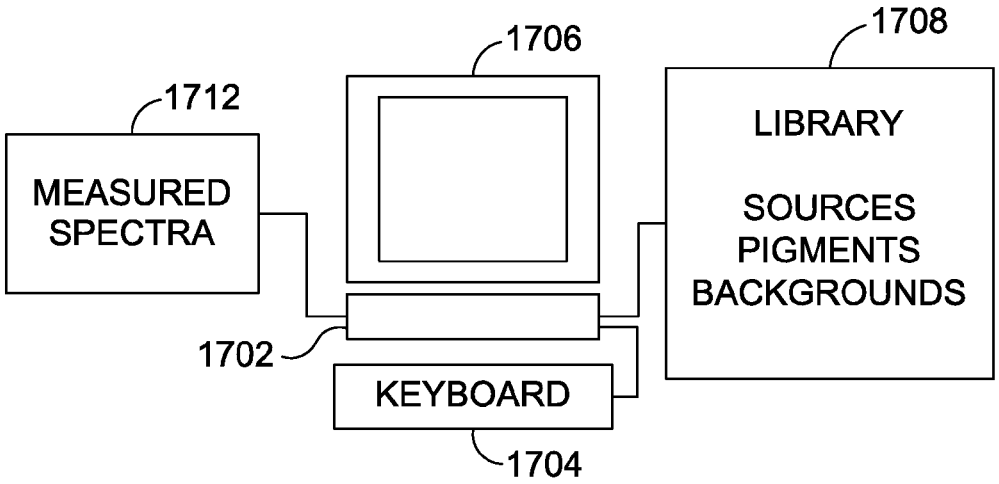
FIG. 17 is a schematic diagram of a representative computer system configured to select colors based on a method such as that of FIG. 16.

A representative apparatus for selecting enhanced visibility colors is illustrated in FIG. 17. A computer 1702 such as a personal computer or a workstation is in communication with a keyboard 1704 and a display 1706. A computer readable medium 1708 such as a hard disk, floppy disk, CD-ROM, RAM, or other medium is configured for storage and retrieval of a data library that can include spectral data associated with, for example, illumination sources, backgrounds such as playing or stadium surfaces, cloud cover, open sky, and pigments or other colorings that can be used. Measured spectra can be provided via a spectrometer 1712 that is configured to acquire additional spectral data as well as measure color combinations as realized so that design and actual color coordinates can be compared. The computer readable medium 1708 can be remote from the computer 1702, and can communicate with the computer via a local area network (LAN) or a wide area network (WAN) such as the Internet. Computer executable instructions for performing EVC selection can be stored on memory in the computer 1702 or on computer readable media external to the computer 1702.

While examples are described above based on particular color representations, in other examples, color representations based on red-green-blue (RGB), cyan-magenta-yellow (CMY), hue-saturation-brightness (HSB), CIE XYZ, CIE xyz, CIE L a b, CIE L u v, Munsell, or other representations can be used. In addition, representative examples described above are based on configuring colors and graphics on a soccer ball, but other examples include balls or similar objects for other sports such as baseball, volleyball, softball, cricket, tennis, lacrosse, hockey, football, skeet shooting, and other sports. Exterior portions of a soccer ball are typically referred to as a casing or casing region, and a graphic or graphic region as used herein. For other balls or objects, first and second exterior regions can be selected and EVCs associated with these regions. For convenience, sporting objects such as balls, pucks, disks, and the like can be referred to as balls. Many other types of objects can be similarly ornamented and colored, and such treatment is particularly useful for objects to be tracked while in motion or during acceleration. In addition, player clothing and apparatus can be similarly configured based on EVCs as described above. Alternatively, visibility can be suppressed by avoiding EVC combinations. Balls and other objects and apparatus for sports are typically more comfortably viewed if their surfaces exhibit diffuse, not specular reflectance, as specular reflectance can be associated with glare from, for example, stadium lighting or the sun. EVCs can also be configured to provide luminance contrast.

The present invention has been described herein in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain the ends and objects set forth above, together with other advantages which are obvious and inherent to the methods, computer-readable media, and graphical user interfaces. It will be understood that certain features and sub-combinations are of utility and may be employed without reference to other features and sub-combinations. This is contemplated by and within the scope of the claims.

The invention claimed is:

1. A method for enhancing visual acuity of a sporting ball, comprising:

selecting a graphic pattern configured to create a rotationally induced peripheral flicker selecting a first color of the graphic pattern, wherein the first color is located at a first position on a CIE (1931) Standard Chromacity Diagram;

selecting a second color of a casing of the sporting ball, wherein the second color is located at a second position on the CIE (1931) Standard Chromaticity Diagram that differs from the first position of the first color, the first position and second position are separated by a distance greater than 50% of a chromatic blend limit extending through both the first position and second position the chromatic blend limit extending substantially perpendicular to a central confusion line; and positioning the graphic on the casing of the sporting ball.

2. The method of claim 1, wherein the selected graphic pattern is configured to delay the onset of fusion as a rotational velocity of the sporting ball increases.

3. The method of claim 2, wherein the selected graphic pattern is configured to account for sporting ball luminance.

4. A method for selecting a casing color and a graphic color of a sporting ball comprising:

defining a graphic region and a casing region on the sporting ball;

selecting a first target color, wherein the first target color is located at a first position on a CIE (1931) Standard Chromaticity Diagram;

selecting a second target color, wherein the second color is located at a second position on the CIE (1931) Standard Chromaticity Diagram that differs from the first position of the first color, the first position and second position are separated by a distance greater than 50% of a chromatic blend limit extending through both the first position and second position the chromatic blend limit extending substantially perpendicular to a central confusion line;

querying a pigment library to select the first target color and the second target color;

assigning the first target color to the graphic region; and assigning the second target color to the casing region.

5. The method of claim 4, further comprising:

identifying a line of color confusion, wherein the selecting of the first target color avoids a predefined color and the chromatic blend limit extends substantially perpendicular to the line of color confusion.

6. The method of claim 4, further comprising:

determining a background, wherein the background is an anticipated background for viewing the sporting ball;

retrieving a background spectral window, associated with the background, from a database; and adjusting at least one of the first target color or the second target color based on the background spectral window.

7. The method of claim 6, wherein adjusting a target color further comprises:

reducing a reflectance of at least one of the first target color or the second target color in at least a portion of the background spectral window.

8. The method of claim 4, wherein the first target color and second target color are assigned a predetermined luminance contrast.

* * * * *